US010458130B2

(12) United States Patent
McDonald et al.

(10) Patent No.: US 10,458,130 B2
(45) Date of Patent: Oct. 29, 2019

(54) DEMOUNTABLE WALL SYSTEM AND METHOD

(71) Applicant: Oldcastle BuildingEnvelope, Inc., Dallas, TX (US)

(72) Inventors: Conor McDonald, Cleveland, OH (US); Joseph Schiavone, Queen Creek, AZ (US); Jeffrey James Phillips, Grand Rapids, MI (US); Nathan Creech, Dallas, TX (US); Gavin Brin, Concord (CA); Kelley Douglass, Weston, CT (US); William Lang, Terrell, TX (US); Jarett Gibson, Terrell, TX (US); James P. Clark, Terrell, TX (US)

(73) Assignee: Oldcastle BuildingEnvelope, Inc., Dallas, TX (US)

( * ) Notice: Subject to any disclaimer, the term of this patent is extended or adjusted under 35 U.S.C. 154(b) by 0 days.

(21) Appl. No.: 16/265,839

(22) Filed: Feb. 1, 2019

(65) Prior Publication Data

US 2019/0234078 A1 Aug. 1, 2019

Related U.S. Application Data

(60) Provisional application No. 62/625,258, filed on Feb. 1, 2018, provisional application No. 62/625,186, filed
(Continued)

(51) Int. Cl.
*E04F 21/18* (2006.01)
*E04B 2/74* (2006.01)

(52) U.S. Cl.
CPC .... *E04F 21/1877* (2013.01); *E04B 2002/749* (2013.01); *E04B 2002/7496* (2013.01)

(58) Field of Classification Search
CPC ..... E04F 21/1877; E04F 15/02464; E04B 2002/7496; E04B 9/20; E04B 2002/749
See application file for complete search history.

(56) References Cited

U.S. PATENT DOCUMENTS 2,304,423 A 12/1942 Schiller
3,455,080 A 7/1969 Meadows
(Continued)

FOREIGN PATENT DOCUMENTS

FR 2 630 145 A1 10/1989
WO 2008/060230 A1 5/2008
WO 2019152887 A1 8/2019

OTHER PUBLICATIONS

PCT/US2019/016417 received an Invitation to Pay Additional Fees and, Where Applicable, Protest Fee dated Apr. 9, 2019, 11 pages.
(Continued)

*Primary Examiner* — Andrew J Triggs
(74) *Attorney, Agent, or Firm* — Kilpatrick Townsend & Stockton LLP

(57) ABSTRACT

A demountable wall system includes a frame component. The frame component may include a front channel that receives a panel of the demountable wall system. In addition to the front channel, the frame component may include at least one of a front cover, a removable back cover, a leveling system, a supplemental channel, or a joining system. In some examples, the demountable wall system includes a door support system for movably supporting a door relative to the panel of the demountable wall system.

7 Claims, 20 Drawing Sheets

Related U.S. Application Data on Feb. 1, 2018, provisional application No. 62/625,208, filed on Feb. 1, 2018, provisional application No. 62/625,275, filed on Feb. 1, 2018, provisional application No. 62/625,315, filed on Feb. 1, 2018.

(56) References Cited

U.S. PATENT DOCUMENTS

| | | | | |
|---|---|---|---|---|
| 3,720,026 | A | 3/1973 | Gasteiger | |
| 3,755,979 | A | 9/1973 | Pantazi | |
| 4,205,498 | A * | 6/1980 | Unayama | E04B 2/822 52/243.1 |
| 4,375,876 | A | 3/1983 | Stewart | |
| 4,467,579 | A | 8/1984 | Weinar | |
| 4,574,547 | A | 3/1986 | Menchetti et al. | |
| 4,991,365 | A * | 2/1991 | Jackson | A47B 91/024 160/135 |
| 5,159,793 | A | 11/1992 | Deugo | |
| 5,479,747 | A * | 1/1996 | Wu | E04B 2/7422 52/220.7 |
| 5,713,159 | A | 2/1998 | Schmidt | |
| 5,737,875 | A | 4/1998 | Dowling | |
| 5,746,025 | A | 5/1998 | Shimura | |
| 5,913,563 | A | 6/1999 | Watanabe | |
| 5,992,109 | A | 11/1999 | Jonker | |
| 6,055,783 | A | 5/2000 | Guhl | |
| 6,170,211 | B1 | 1/2001 | Boyer | |
| 6,550,152 | B2 * | 4/2003 | Myrick | G01C 9/26 33/375 |
| 6,550,848 | B2 | 4/2003 | Kleemann | |
| 6,688,056 | B2 | 2/2004 | Von Hoyniingen Huene | |
| 7,155,861 | B2 | 1/2007 | Berry | |
| 7,241,352 | B2 | 7/2007 | Crandell | |
| 7,490,445 | B2 | 2/2009 | Steffek | |
| 7,588,653 | B2 | 9/2009 | Crandell | |
| D616,566 | S | 5/2010 | Desrosiers | |
| 7,997,037 | B2 | 8/2011 | Crandell | |
| 8,621,793 | B2 | 1/2014 | Abdul Lathief | |
| 8,925,258 | B1 * | 1/2015 | Header | E05D 15/00 16/90 |
| 9,057,201 | B2 * | 6/2015 | Milligan | E04F 21/1877 |
| D777,948 | S | 1/2017 | Veerasawmy | |
| 9,540,861 | B2 | 1/2017 | Abdul Lathief | |
| 9,617,743 | B2 * | 4/2017 | Brown | E04F 21/1877 |
| 9,683,402 | B2 | 6/2017 | Abdul Lathief | |
| 9,765,518 | B2 | 9/2017 | Von Hoyningen Huene | |
| 9,797,185 | B2 | 10/2017 | Abdul Lathief | |
| D809,704 | S | 2/2018 | Klus | |
| 9,945,511 | B2 * | 4/2018 | Mitrovic | E04B 2/7401 |
| 10,053,858 | B2 * | 8/2018 | Kopish | E05D 15/063 |
| D828,142 | S | 9/2018 | Macdonald | |
| D834,397 | S | 11/2018 | Macdonald | |
| 2003/0089054 | A1 | 5/2003 | Homung | |
| 2004/0206027 | A1 * | 10/2004 | Steele | E04F 21/185 52/272 |
| 2004/0216383 | A1 | 11/2004 | Rogers, Jr. | |
| 2004/0231255 | A1 | 11/2004 | Silverman | |
| 2005/0055906 | A1 | 3/2005 | Barnard | |
| 2006/0185273 | A1 | 8/2006 | Abdul Lathief | |
| 2007/0044411 | A1 | 3/2007 | Meredith et al. | |
| 2007/0119548 | A1 | 5/2007 | Anderson | |
| 2008/0209809 | A1 | 9/2008 | Petridis | |
| 2009/0126279 | A1 | 5/2009 | Kopish | |
| 2009/0199498 | A1 | 8/2009 | Ting | |
| 2011/0126471 | A1 | 6/2011 | Hans | |
| 2011/0286792 | A1 | 11/2011 | Henriott et al. | |
| 2012/0247022 | A1 | 10/2012 | McDonough | |
| 2013/0192141 | A1 * | 8/2013 | Kopish | E05D 15/063 49/413 |
| 2013/0192148 | A1 * | 8/2013 | Milligan | E04F 21/1877 52/126.4 |
| 2013/0320140 | A1 | 12/2013 | Cheung | |
| 2014/0000085 | A1 | 1/2014 | Teller et al. | |
| 2014/0003861 | A1 | 1/2014 | Cheung et al. | |
| 2014/0033642 | A1 | 2/2014 | Foran | |
| 2014/0115982 | A1 | 5/2014 | Abdul Lathief | |
| 2014/0215938 | A1 | 8/2014 | Kopish et al. | |
| 2015/0020453 | A1 | 1/2015 | Karl | |
| 2015/0047280 | A1 | 2/2015 | Staten et al. | |
| 2015/0059269 | A1 | 3/2015 | Ting | |
| 2015/0300027 | A1 | 10/2015 | Day et al. | |
| 2015/0354212 | A1 | 12/2015 | Von Hoyningen Huene | |
| 2016/0160500 | A1 | 6/2016 | Yu et al. | |
| 2016/0206157 | A1 | 7/2016 | Ball et al. | |
| 2018/0045363 | A1 * | 2/2018 | Mitrovic | E04B 2/7401 |

OTHER PUBLICATIONS

U.S. Appl. No. 16/265,869 received a Non-Final Office Action, dated Mar. 18, 2019, 10 pages.

International Search Report and Written Opinion from related PCT Application PCT/US2019/016417, dated Jul. 1, 2019, 18 pages.

Final Office Action from Related U.S. Appl. No. 16/265,869 dated Sep. 11, 2019, 9 pages.

* cited by examiner

DEMOUNTABLE WALL SYSTEM AND METHOD

REFERENCE TO RELATED APPLICATIONS

This application claims the benefit of U.S. Provisional Patent Application No. 62/625,256, filed on Feb. 1, 2018 and entitled LEVEL FOR DEMOUNTABLE WALL SYSTEM; U.S. Provisional Patent Application No. 62/625,186, filed on Feb. 1, 2018 and entitled DOOR ENCLOSURE FOR DEMOUNTABLE WALL SYSTEM; U.S. Provisional Application No. 62/625,315, filed on Feb. 1, 2018 and entitled FRONT LOCKING COVER FOR DEMOUNTABLE WALL SYSTEM; U.S. Provisional Patent Application No. 62/625,275, filed on Feb. 1, 2018 and entitled BACK CHANNEL FOR DEMOUNTABLE WALL SYSTEM; and U.S. Provisional Patent Application No. 62/625,208, filed on Feb. 1, 2018 and entitled CORNER JOINING FOR DEMOUNTABLE WALL SYSTEM, the disclosures of which are hereby incorporated by reference in their entireties.

FIELD OF THE INVENTION

This application relates to demountable wall systems, and, more particularly, demountable wall systems and methods for easy installation and customization.

BACKGROUND

Demountable wall systems, and particularly demountable wall systems using glass panels, are used in both residential and commercial settings. Compared to traditional, fixed wall systems, demountable wall systems include panels (e.g., glass panels, metal panels, wood panels, composite panels, polymer panels, concrete panels, fabric-covered acoustic panels, gypsum, etc.) that can be unmounted, relocated, and reinstalled at new locations relatively quickly, and thus provide increased design flexibility. The panels are also often interchangeable such that the wall system can be customized to the particular needs of the setting (e.g., panels can be swapped for panels with different finishing options, different material properties, etc.). Due to their flexibility, demountable wall systems can be used for a variety of different purposes when installed, including, but not limited to, sound control (acoustical protection), light and solar control, seismic control, safety, air and water resistance, thermal control, clean rooms, emergency egress and ingress, lockability (ability to lock rooms or spaces defined by the wall systems), etc.

Traditionally, demountable wall systems include a frame that is positioned within the area or setting to receive the wall system. The frame includes upper frame components, lower frame components, and/or side frame components depending on the particular shape or needs of the wall system. Lower frame components of traditional wall systems often define a channel to receive the glass panel, and a front of the channel has a lip. To install the glass panel, the glass panel is lifted into the channel of the upper frame component such that the panel can clear the lip of the lower frame component, pushed backwards, and then lowered into the channel of the lower frame component. As such, the channel of the upper frame component must have a sufficient depth to accommodate the lifting and lowering action during installation as well as retain the glass panel on the frame after installation.

Because the panels are often heavy and the installation requires relatively complex movements in a limited space, installation of the glass panels is not easy, and panels may become damaged if improperly installed. Uninstalling the panel is likewise relatively difficult to perform. Moreover, after installation, a gap may exist between a top of the glass panel and the base of the channel of the upper frame component, which may lead to substandard performance of the wall system due to improper sealing, misaligned or angled panels, etc. Additionally, traditional demountable wall systems are unable to account for any variations in surfaces on which the system is mounted such as warped or slated floors and/or walls, unlevel or non-parallel floors and/or ceilings, etc.

Furthermore, in some cases, it can be time-consuming to join two frame components where they meet in a way that has an aesthetically pleasing appearance. Frame components may be joined in various configurations, such as an end-to-end configuration (where frame components are joined through a butt joint or other suitable end to end joint) or a corner configuration (where frame components are joined at an angle from as small as 0.1 degrees to up to 359.9 degrees to form a corner). The term "corner" is understood to mean any joining angle in which the longitudinal axes of both components are not arranged substantially parallel to one another, and the term "straight" or "butt" joint is understood to mean any joining arrangement in which the longitudinal axes of both components are arranged substantially parallel to one another. As such, there is a need for demountable wall systems that are easy to install and customize in various joined configurations.

Additionally, in certain cases, it may be preferable to use a sliding door with the demountable wall system to conserve space compared to a conventional swinging door. The use of a sliding door, however, may not provide a suitable sound barrier for the enclosure because the sliding door is typically not snugly fitted against and/or within the door opening. As a result, there is also a need to provide an improved sliding door design that can be used with the demountable wall systems while minimizing the impact on the quality of the sound barrier provided by the demountable wall system.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a demountable wall system includes a frame component defining a front channel and a front cover removably attached to the frame component such that the front cover covers a front portion of the front channel.

According to certain embodiments of the present invention, a method of installing a panel on a frame of a demountable wall system includes positioning the panel in a front channel defined by a frame component of the frame. The method includes removably attaching a front cover to the frame component such that the front cover partially covers the panel in the front channel, and inserting a wedge between the panel and the front cover.

According to certain embodiments of the present invention, a demountable wall system includes a frame component defining a front channel and a leveling base within the front channel. The leveling base is vertically positionable within the front channel through at least one adjustment screw.

According to certain embodiments of the present invention, a method of installing a panel on a frame of a demountable wall system includes positioning the panel in a front channel defined by a frame component of the frame and on a leveling base within the front channel. The method includes vertically positioning at least a portion of the panel by adjusting at least one adjustment screw to vertically adjust a portion of the leveling base.

According to certain embodiments of the present invention, a method of installing a panel on a frame of a demountable wall system includes vertically positioning a leveling base within a front channel defined by a frame component of the frame by adjusting at least one adjustment screw to vertically adjust a portion of the leveling base. The method includes positioning the panel on the leveling base within the front channel.

According to certain embodiments of the present invention, a demountable wall system includes a frame component defining a front channel and a back channel. The front channel is configured to receive a panel, and the back channel is configured to removably connect to a supplementary component.

In some examples, the supplementary component is a back cover. In various examples, the supplementary component is a supplemental frame component.

According to certain embodiments of the present invention, a demountable wall system includes a frame component that defines a front channel and locking slot. The demountable wall system also includes a front cover with a key, and the key is removably positionable within the locking slot such that the front cover covers a front portion of the front channel.

According to certain embodiments of the present invention, a method of installing panel on a frame of a demountable wall system includes positioning the panel in a front channel defined by a frame component of the frame. The method includes inserting a key of a front cover into a locking slot defined by the frame component such that the front cover partially covers the panel in the front channel. The method includes inserting a wedge between the panel and the front cover.

According to certain embodiments of the present invention, a demountable wall system includes a door coupled to a track mechanism. The track mechanism includes a mechanism configured to move the door in a direction that is approximately 90 degrees relative to a longitudinal axis of the track mechanism.

In some examples, the mechanism includes an offset turn mechanism comprising a cylinder with a cutout region shaped to engage with a roller attached to the door.

According to certain embodiments of the present invention, a method of joining two frame components includes inserting a first fastener into an internal location within a first frame component and coupling a second fastener to the first fastener. The method includes engaging the second fastener with a receptacle located in a second frame component and adjusting the first fastener to pull adjoining ends of the two frame components together into a snug fit.

According to certain embodiments of the present invention, a system for joining two frame components includes a first fastener and a second fastener. The first fastener is engageable with a first frame component, and the second fastener is engageable with the first fastener and a second frame component. Adjustment of the first fastener induces linear displacement of the second fastener.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others, are intended to refer to the orientation as illustrated and described in the figure (or figures) to which the components and directions are referencing.

Embodiments of the present invention are directed to improved demountable wall systems. In some examples, the demountable wall systems include a frame component with a front locking cover. In other examples, the demountable wall systems include a frame component with a removable back cover. In certain examples, the demountable wall systems include a frame component with a level. In some aspects, the demountable wall systems include a frame component with a front channel and a supplemental channel. In various aspects, the demountable wall systems include a corner joining member. In some examples, the demountable wall systems include a door enclosure mechanism. Various other features are provided below. It will be appreciated that while the features are described separately, a demountable wall system and/or frame component of the demountable wall system may include any combination of features as desired.

Demountable Wall System

Figure 1:
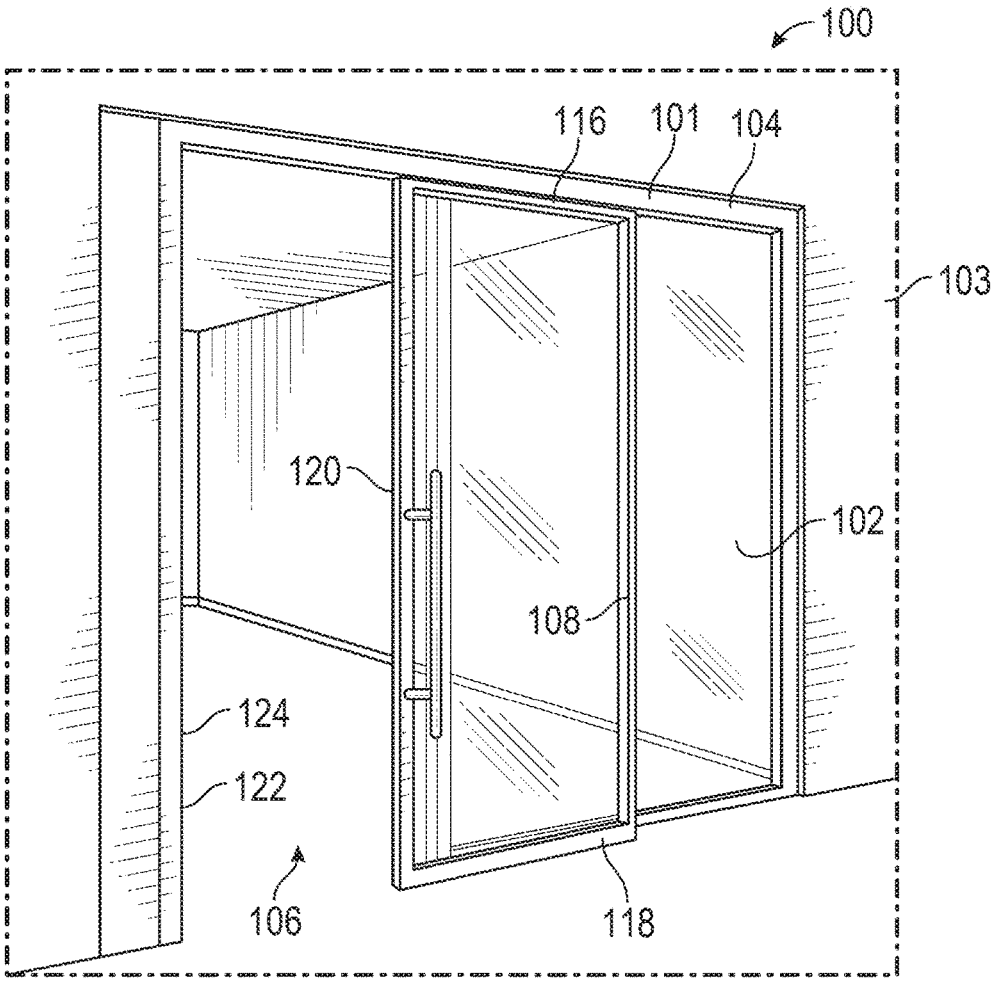
FIG. 1 is a perspective view of a demountable wall system having at least one frame component according to aspects of the present disclosure.
Figure 2:
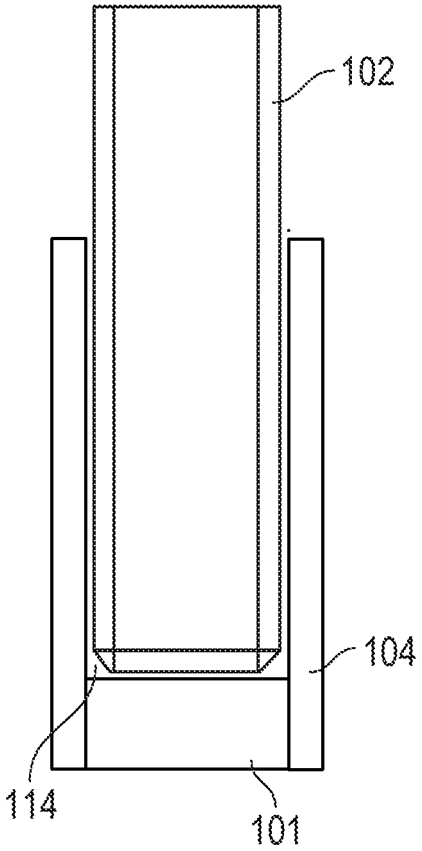
FIG. 2 is a side view of the at least one frame component of FIG. 1.

FIGS. 1 and 2 illustrates an example of an improved demountable wall system 100 according to aspects of the preset disclosure. The demountable wall system 100 includes a frame 101 having one or more frame components 104 that support a panel 102 to form a wall or other similar structure.

The demountable wall system 100 and may be incorporated into various environments and as such may have various suitable shapes or configurations as desired. In some cases, the demountable wall system 100 may be a stand-alone, self-supporting structure. In other examples, and as illustrated in FIG. 1, the demountable wall system 100 may be incorporated as a component of a larger wall 103

The frame component 104 of the frame 101 may be an upper frame component, a lower frame components, a side frame component, etc. In some cases where a plurality of frame components 104 are included, the frame components 104 include the same components as discussed below; however, in other examples, one frame component 104 may have features that are different from another frame component 104. The frame component 104 may be constructed from various materials including, but not limited to, various metals, woods, plastics, composites, fiber-reinforce polymers, other suitable materials, or combinations thereof. In certain examples, the frame component 104 is formed through an extrusion process, although other techniques may be used to form the frame component 104. In one non-limiting example, the frame component 104 is an extruded aluminum component, but may also be formed of any suitable metal or fiber reinforced polymer, such as carbon fiber.

As illustrated in FIG. 2, the frame component 104 of the frame 101 defines at least one channel 114. When the demountable wall system 100 is assembled, at least a portion of the panel 102 is positioned within the channel 114. The panel 102 may be various suitable types of panels for forming a wall or similar structure including, but not limited to, glass panels, metal panels, wood panels, composite panels, polymer panels, concrete panels, fabric-covered acoustic panels, gypsum, etc.

In certain embodiments, the demountable wall system 100 optionally includes an opening or doorway 106 through which a person accesses an area that is at least partially enclosed by the demountable wall system 100. In order to provide additional privacy and/or some sound proofing, a door 108 may be attached to the panel 102 and/or the frame component 104. The door 108 may be configured to extend from the floor to the ceiling or may have any suitable height or width that substantially contours to the dimensions of the opening 106. In other words, the door dimensions may be substantially the same as or slightly smaller than the dimensions of the opening 106 for embodiments where the door 108 fits within the opening 106 in an engaged position, as discussed in more detail below. In other embodiments, the door dimensions may be larger than the dimensions of the opening to ensure that the door overlaps the edges of the opening 106 for embodiments where the door 108 is pressed against the opening 106 in an engaged position, as discussed in more detail below. In further embodiments, the door 108 may be configured to swing or slide into place within the opening 106. Examples of suitable doors 108 may include solid doors such as barn doors, panel doors, doors with glass or other inserts, framed or frameless glass doors, or other suitable designs.

In the example of FIG. 1, and as discussed in greater detail below with reference to FIGS. 23-26B, the door 108 is slidable along a track such that the door 108 can slide between a closed position (in which the door 108 blocks the opening 106) and an open position (in which at least a portion of the opening 106 is not covered by the door 108. In some cases, the track may be attached to an upper portion 116 of the door 108, a lower portion 118 of the door 108, or other suitable location. In the closed position, an edge 120 of the door 108 is positioned adjacent to a corresponding edge 122 of the opening 106. In some cases, the edge 120 abuts the edge 122 in the closed position; however, in other examples, a gasket 124 may be provided on the edge 120 and/or the edge 122 such that the gasket 124 is compressed by the door 108 in the closed position, which may contribute to the sound insulation of the wall system 100. In other examples, the gasket 124 may be positioned on a surface surrounding the periphery of the opening 106 and/or around the periphery of the door 108 so that the gasket is compressed as the door 108 is pressed against edges of the opening 106. In other examples, the opening 106 and/or door 108 may be omitted from the demountable wall system 100.

Front Locking Cover

FIGS. 3-6 illustrate another example of a frame component 304 that can be used with the demountable wall system 100. The frame component 304 is substantially similar to the frame component 104 and includes the front channel 114. In some examples, the frame component the front channel 114 includes a gasket 315 or other suitable sealing member for forming a seal with the panel 102 when the panel 102 is positioned within the front channel 114. Optionally, a back spacer 328 may be positioned between the panel 102 and the frame component 304. When included, the back spacer 328 may be positioned before or after the panel 102 is positioned on the frame component 304.

Figure 15:
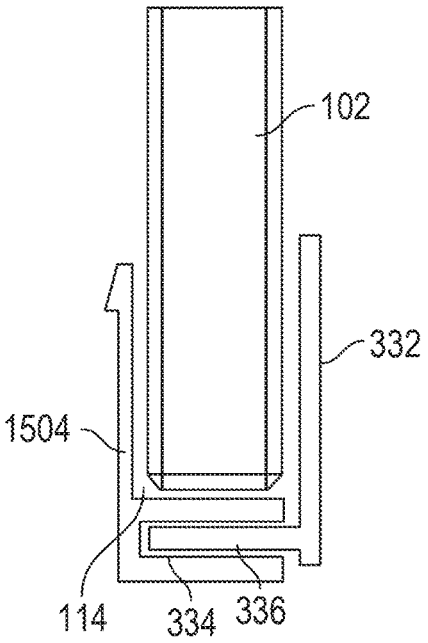
FIG. 15 is a side view of a frame component of a demountable wall system with one panel, and the frame component includes one channel according to aspects of the present disclosure.
Figure 16:
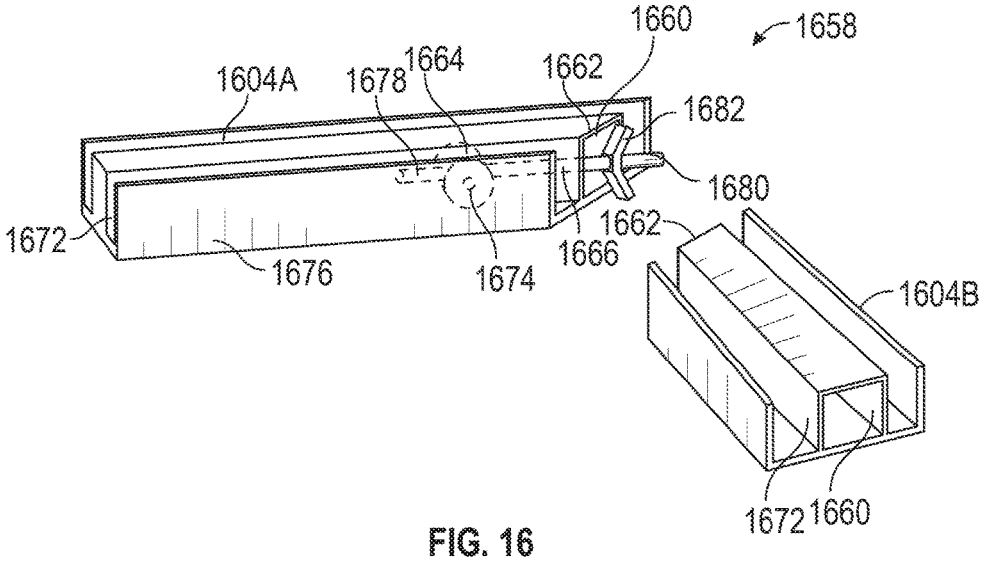
FIG. 16 is a perspective view of two frame components of a demountable wall system with a joining system according to aspects of the present disclosure.
Figure 17:
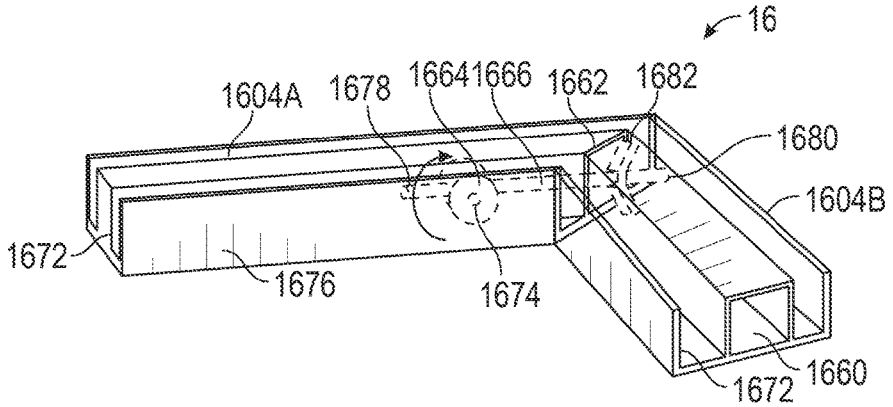
FIG. 17 is another perspective view of the frame components and joining system of FIG. 16.
Figure 18:
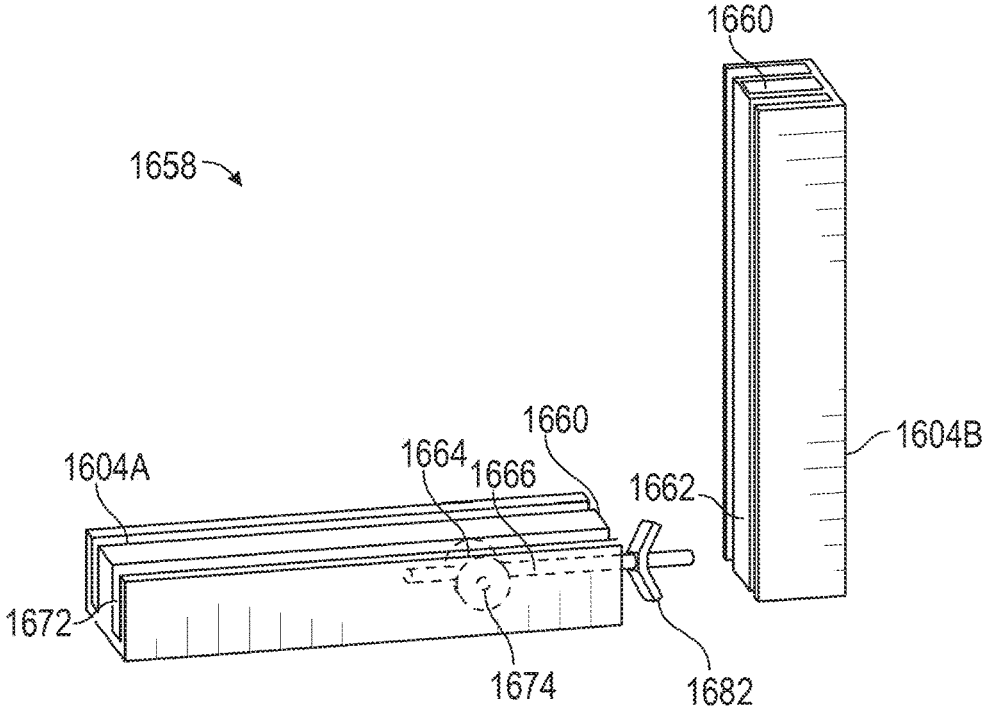
FIG. 18 is another perspective view of two frame components and the joining system of FIG. 16.
Figure 19:
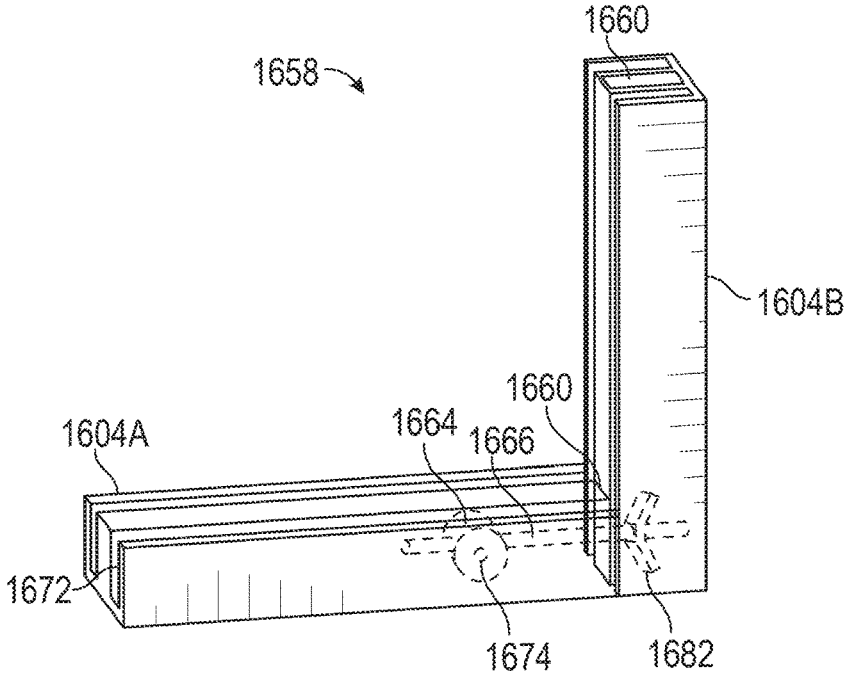
FIG. 19 is another perspective view of the frame components and the joining system of FIG. 16.

Compared to the frame component 104, the frame component 304 also includes a back channel 326. When included, various infrastructure components such as wiring, piping, securing mechanisms, etc. may optionally be received within the back channel 326. Optionally, the back channel 326 may be omitted, and the frame component 304 only forms the front channel 114. FIG. 15 illustrates an example of a frame component 1504 that is substantially similar to the frame component 304 but omits the back channel 326.

A back cover 330 may at least partially form the back channel 326 and cover the back channel 326. In some examples, as illustrated in FIGS. 3-6, the back cover 330 is monolithically formed with the frame component 304; however, in other examples, and as discussed below with reference to FIGS. 9-12, the back cover 330 is a separate component that is removably attached to the frame component 304 such that the back channel 326 can be selectively uncovered. The back cover 330 may be constructed from various suitable materials. In some cases, the frame component 304 and back cover 330 are constructed from the same material, although they need not in other examples.

As illustrated in FIGS. 3-6, compared to the frame component 104, the frame component 304 optionally includes a removable front cover 332. When the front cover 332 is assembled with the frame component 304, the front cover 332 encloses a front portion of the front channel 114 and at least partially overlaps the panel 102.

In examples with the removable front cover 332, the frame component 304 may define a locking slot 334 generally below the front channel 114. The locking slot 334 may extend continuously along a length of the frame component 304, although in other examples, one or more locking slots 334 may be provided at various spaced apart positions along the length of the frame component 304. As illustrated in FIGS. 3-6, in some cases, the locking slot 334 is arcuate-shaped so that it complements the shape of a key 336 of the front cover 332.

As illustrated in FIGS. 3-6, the key 336 may be at an intermediate position on the front cover 332 between opposing ends of the front cover 332. In other examples, the key 336 may be at an end of the front cover 332. The key 336 may extend continuously along a length of the front cover 332, although in other examples, one or more keys 336 may be provided at various spaced apart positions along the length of the front cover 332. In other examples, the locking slot 334 may have other shapes complimentary to the shape of the key 336 such that the key 336, and thus the front cover 332, is held in place when the key 336 is positioned within the locking slot 334. In certain examples, the key 336 and locking slot 334 are shaped such that, when the key 336 is within the locking slot 334, a purely horizontal force that is parallel to the ground does not dislodge the key 336 from the locking slot 334.

In other examples, the locking slot 334 and key 336 may be omitted, and the front cover 332 may be attached to the frame component 304 using any suitable permanent or non-permanent fastening means. Any suitable permanent or non-permanent fastening means that apply mechanical, electromechanical, piezoelectric, vacuum, magnetic, and/or friction force to join the front cover 332 to the frame component 304 may be used. Examples of mechanical fastening means include, but are not limited to, snap-fit, hook and loop, snaps, clasps, nuts and bolts, screws, pins and rivets, cams, and ratchets. Examples of vacuum fasteners may include, but are not limited to, suction cups and the like. Examples of magnetic fasteners may include, but are not limited to, hidden fasteners that can be turned through application of a magnetic field (such as those described in http://swissinvis-.com/products/). Examples of additional fastening means may include, but are not limited to, gravity, crimping, welding, soldering, brazing, taping, gluing, cementing, riveting, magnets, electromagnets, camming, spring closures, snap-fit, hinges, friction lock systems, hook and loop fasteners, dual lock fasteners, zippers, clinching, thermodynamic materials, elastic materials, wedge locking, the use of other adhesives, or various other fastening mechanisms.

Figure 3:
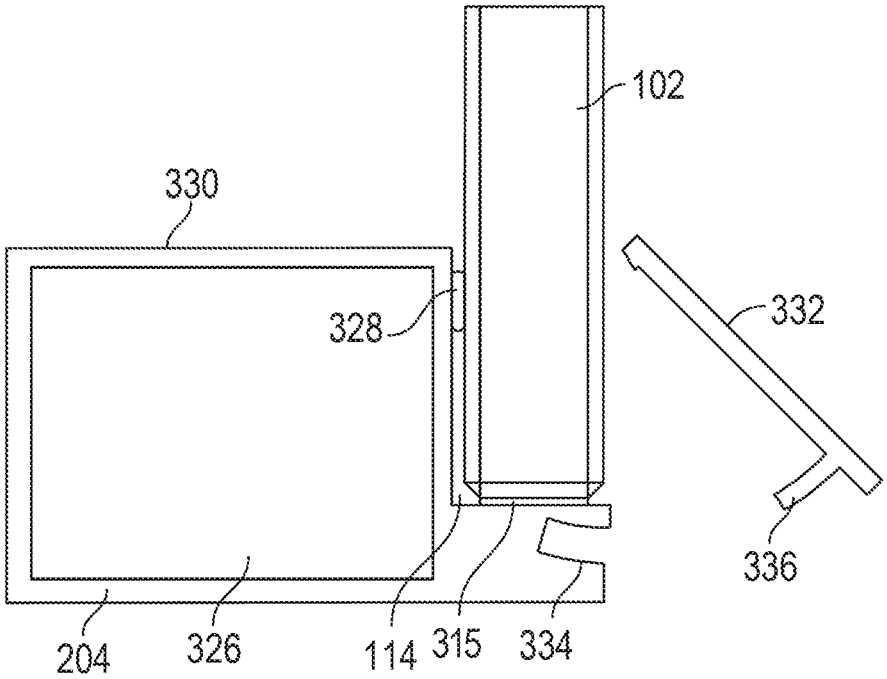
FIG. 3 is a side view of a frame component of a demountable wall system with a panel, and the frame component includes a front cover according to aspects of the present disclosure.
Figure 4:
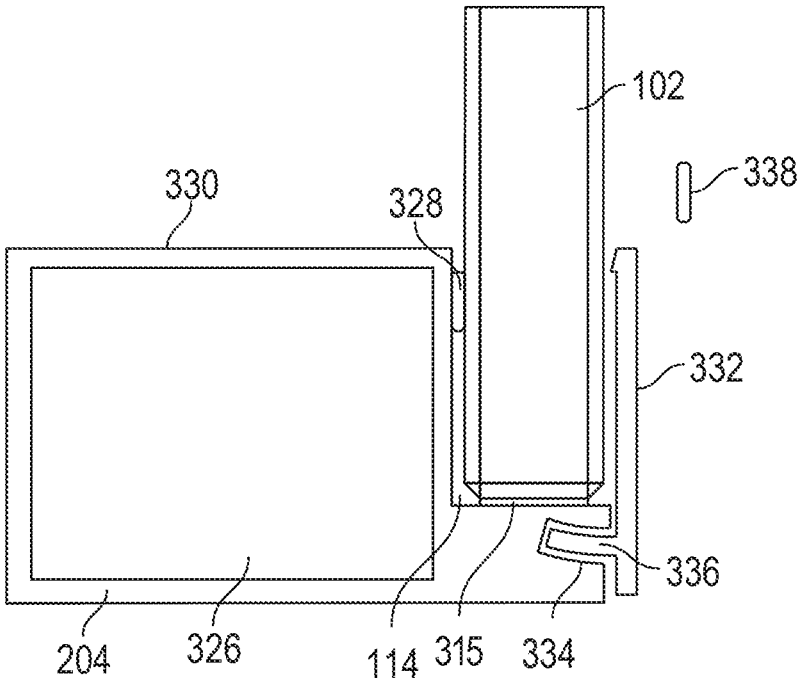
FIG. 4 is another side view of the frame component and panel of FIG. 3.
Figure 5:
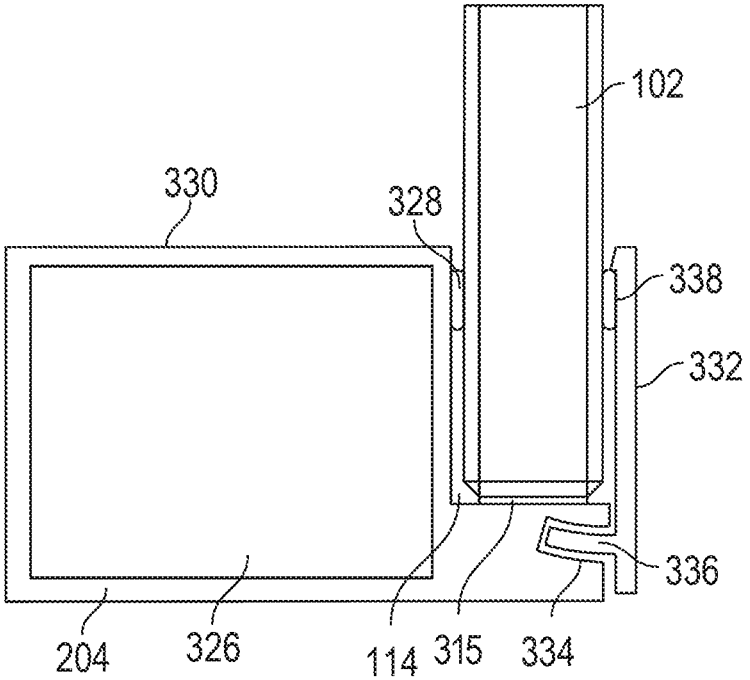
FIG. 5 is another side view of the frame component and panel of FIG. 3.
Figure 6:
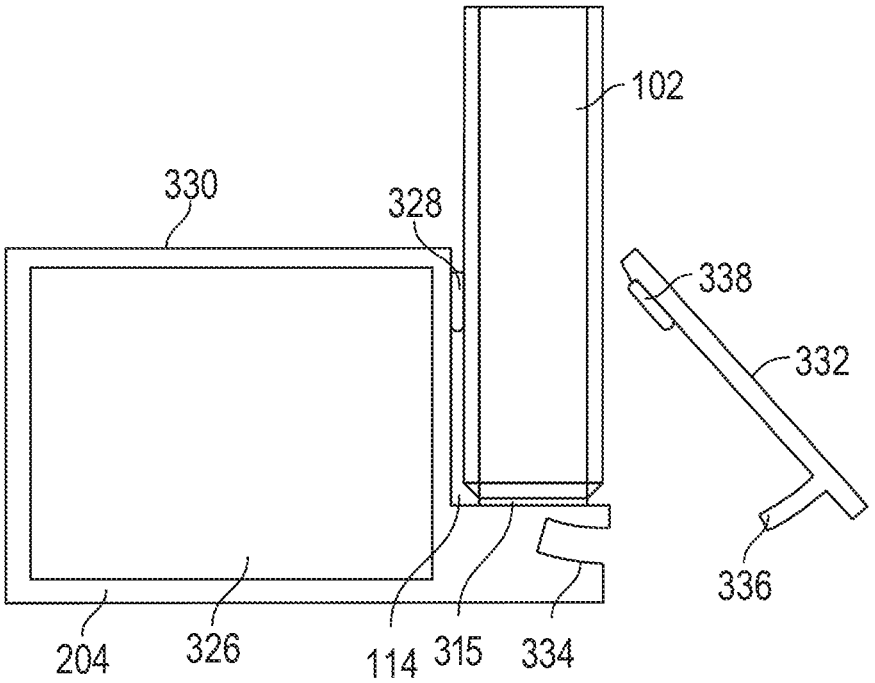
FIG. 6 is another side view of the frame component and panel of FIG. 3.

In various examples, a spacer 338, such as a wedge gasket or other suitable component, may be positioned between the front cover 332 and the panel 102. In some examples, as illustrated in FIGS. 3-5, the spacer 338 is a separate component that is positionable between the front cover 332 and the panel 102 before or after the panel 102 is positioned within the channel 114. In other examples, as illustrated in FIG. 6, the spacer 338 and front cover 332 are a single component. For example, the spacer 338 can be pre-secured to the front cover 332 or, alternatively, the spacer 338 can be integrally or monolithically formed with the front cover 332. In addition to forming a seal between the front cover 332 and the panel 102, the spacer 338 may apply cantilevered pressure on the front cover 332 to further lock the front cover 332 in place on the frame component 304.

A method of installing the panel 102 with the frame component 304 includes positioning the panel 102 in the front channel 114 defined by the frame component 304. Optionally, positioning the panel 102 in the front channel 114 includes positioning the panel 102 on the gasket 315. After the panel 102 is positioned, the method may include inserting the key 336 of the front cover 332 into the locking slot 334. In some aspects, inserting the key 336 includes rotating the front cover 332. The method may include inserting the spacer 338 between the panel 102 and the front cover 332 such that the spacer 338 applies cantilevered pressure on the front cover 332 to further lock the front cover 332 in place. To disassemble the demountable wall system 100, the method may include removing the spacer 338 from between the panel 102 and the front cover 332 such that the pressure is no longer applied against the front cover 332. The method may include removing the key 336 from the locking slot 334. In some cases, removing the key 336 includes rotating the front cover 332 in an opposite direction from the installation direction. After the front cover 332 is removed, the panel 102 may be removed.

With the frame component 304 having the front cover 332, an installer can easily install and uninstall a panel 102 from demountable wall system 100 without having to lift and lower the panel over a lip as traditionally required. The frame component 304 with the front cover 332 also allows for increased tolerance or variation in the panels 102 compared to traditional systems because the panel 102 does not need to first clear a lip. For example, traditional lift and drop systems can only accommodate minor variations in panel size because the panels 102 must clear the lip to be installed, and any imprecisely measured panels 102 must be discarded because they cannot fit over the lip. In contrast, because the frame component 304 with the front cover 332 does not require the panel 102 to clear a lip, the frame component 304 with the front cover 332 can compensate for any likely imprecision in the measurement of the panel 102 due to the increased space. Thus, the demountable wall system 100 allows for imprecisely measured panels 102, which would otherwise be discarded in traditional systems, to still be used with the demountable wall system 100. Additionally, the amount of installation time needed to install the panel 102 on the frame component 304 is reduced because the time needed to carefully clear the lip and/or correct imprecise panels is reduced or eliminated. The increased space provided by the frame component 304 may also allow for larger panels 102 to be used compared to traditional systems. In some examples, the frame component 304 with the front cover 332 may reduce and/or eliminate the need for a lot of secondary fasteners to assemble the wall system, which may further reduce the amount of installation time needed.

Leveling System

Figure 7:
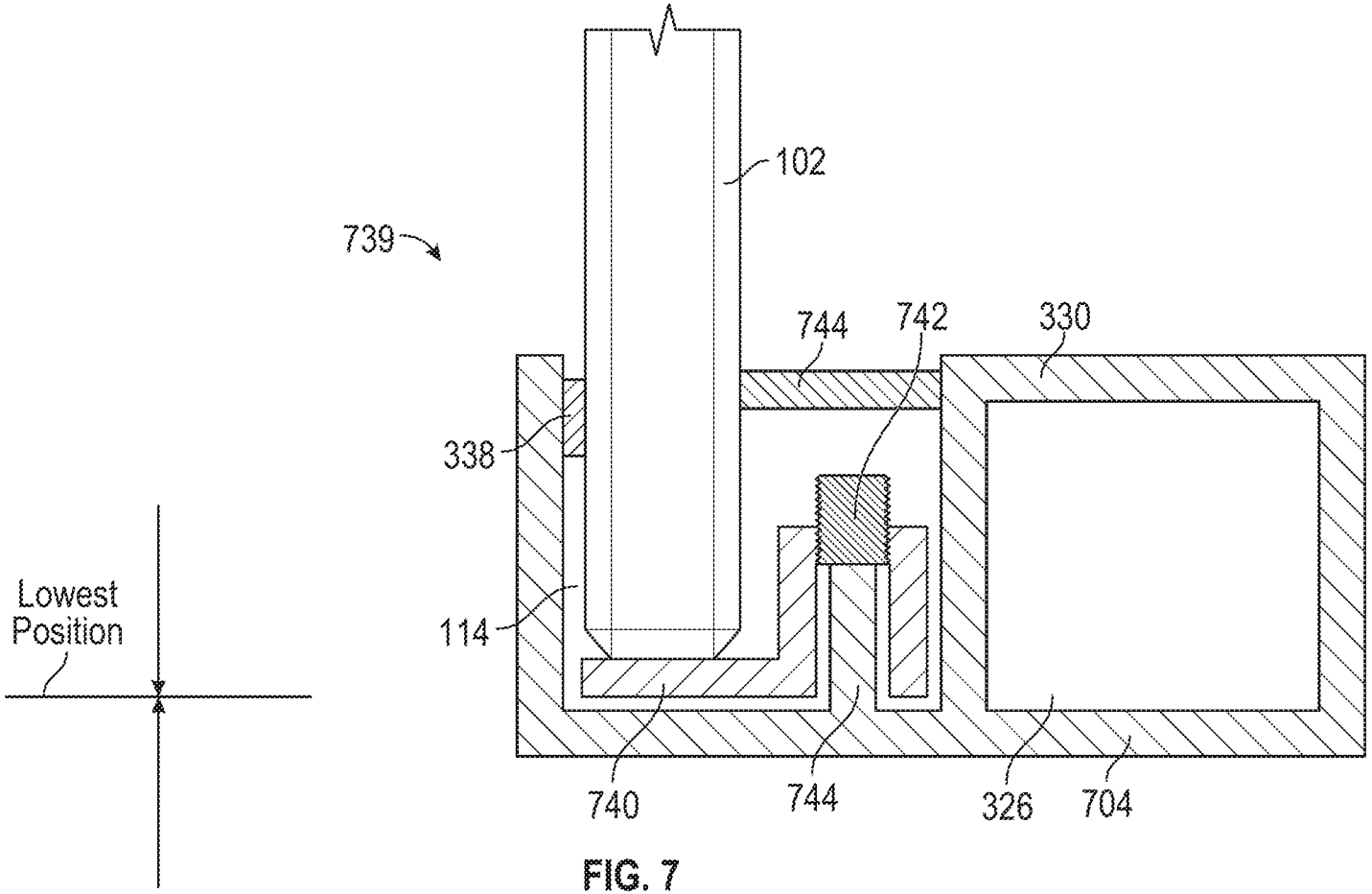
FIG. 7 is a sectional view of a frame component of a demountable wall system with a panel, and the frame component includes a leveling system according to aspects of the present disclosure.
Figure 8:
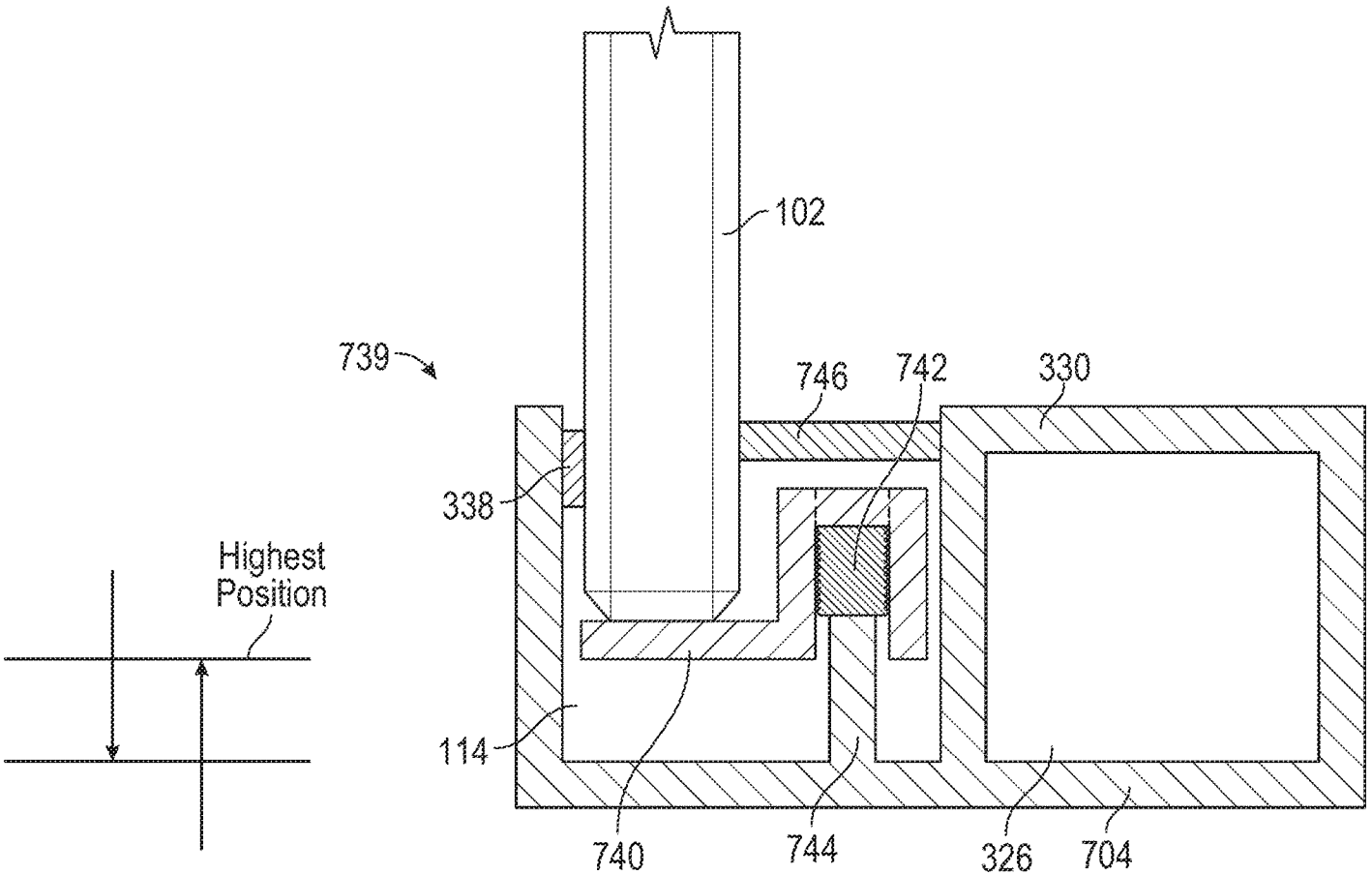
FIG. 8 is another sectional view of the frame component of FIG. 7.
Figure 9:
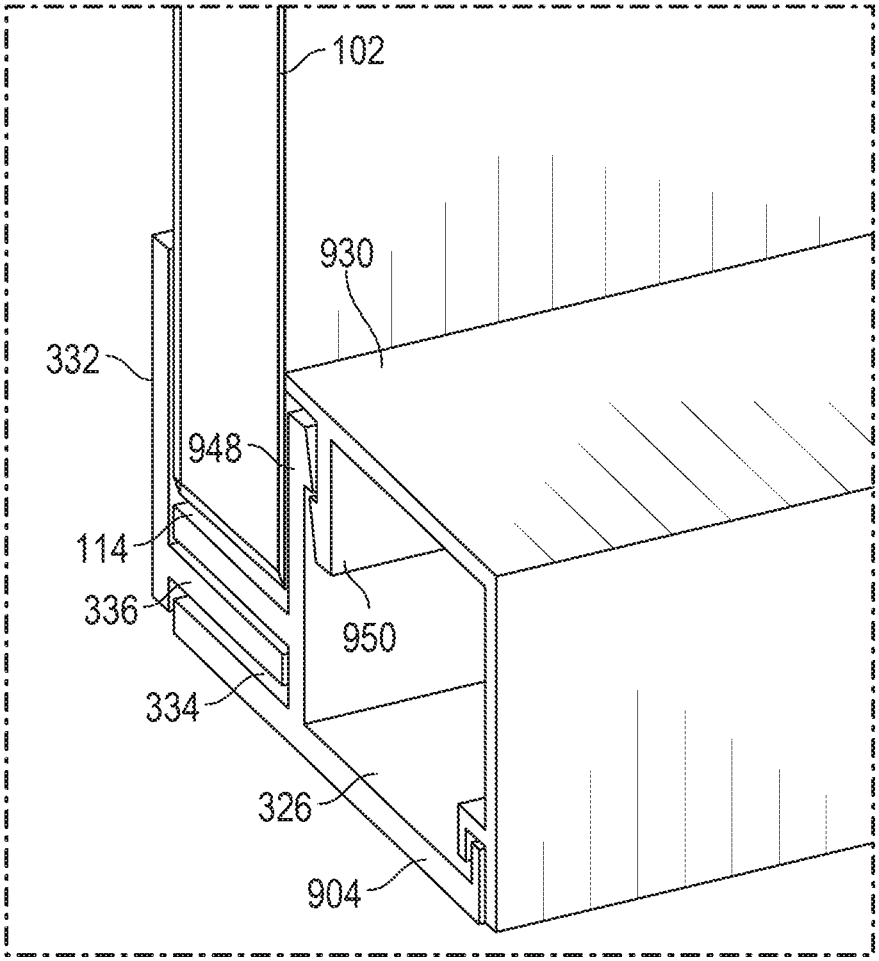
FIG. 9 is a perspective view of a frame component of a demountable wall system with a panel, and the frame component includes a removable back cover according to aspects of the present disclosure.
Figure 10:
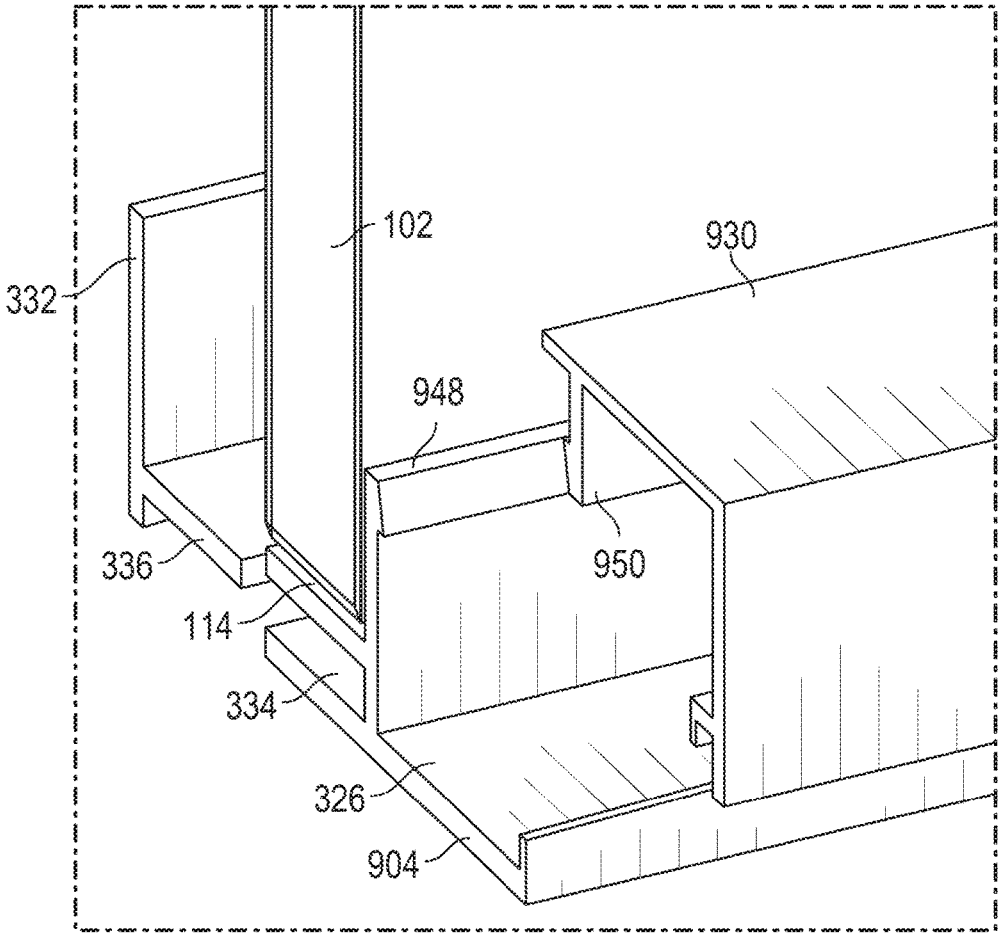
FIG. 10 is another perspective view of the frame component of FIG. 9.
Figure 11:
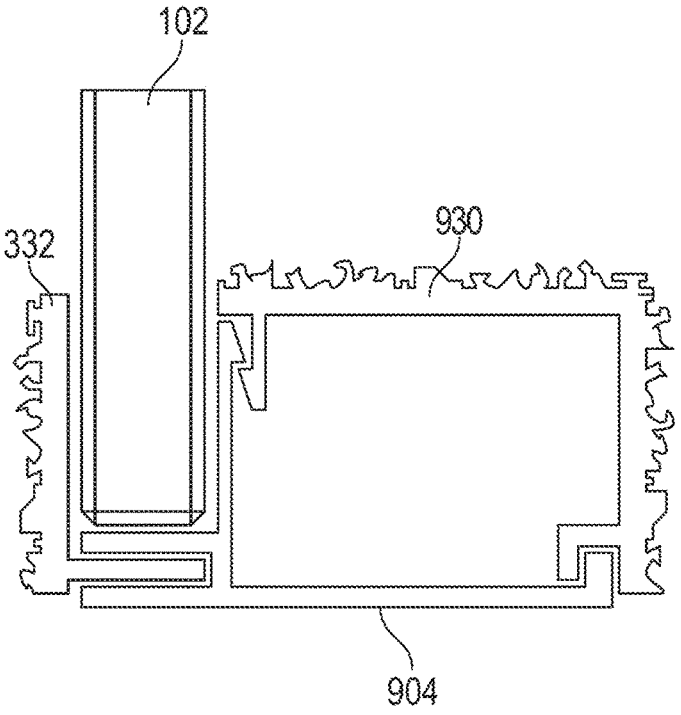
FIG. 11 is a side view of the frame component of FIG. 9 with another back cover.
Figure 12:
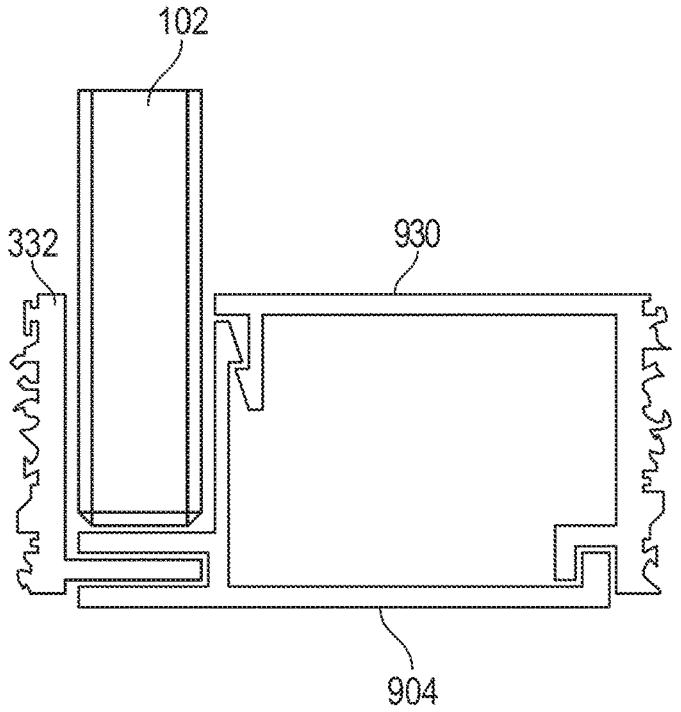
FIG. 12 is a side view of the frame component of FIG. 9 with another back cover.
Figure 13:
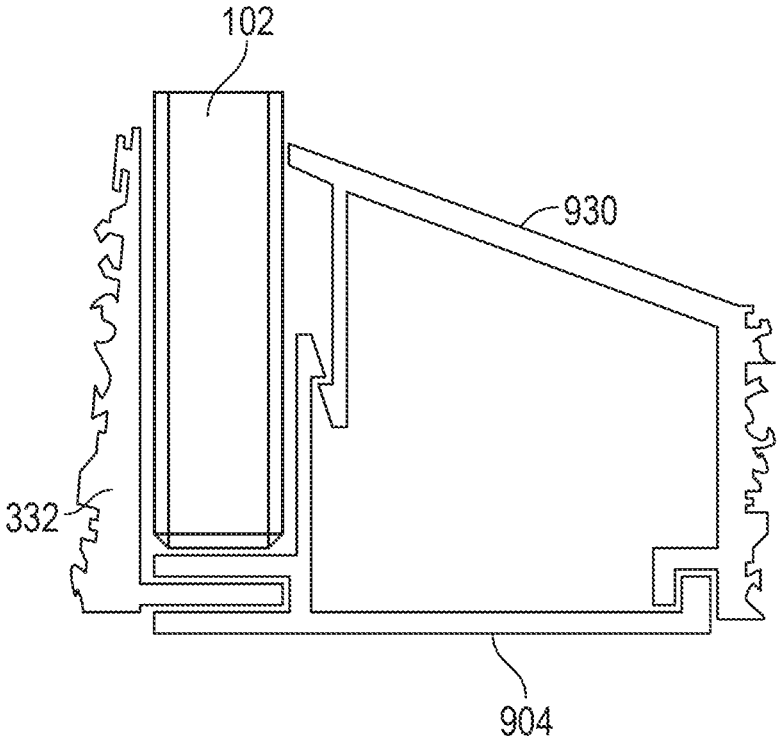
FIG. 13 is a side view of the frame component of FIG. 9 with another back cover.

FIGS. 7 and 8 illustrate another example of a frame component 704 that can be used with the demountable wall system 100. Compared to the frame components 104 and 304, the frame component 704 includes a leveling system 739 with a leveling base 740 within in the front channel 114. As illustrated in FIGS. 6 and 7, the panel 102 may be assembled with the frame component 704 by positioning the panel 102 on the leveling base 740 within the front channel 114. The leveling base 740 is vertically adjustable such that a vertical position of the panel 102 can be adjusted and controlled as desired. For example, FIG. 7 illustrates an example of the leveling base 740, and thus panel 102, in a lowest position, and FIG. 8 illustrates an example of the leveling base 740 in a highest position.

The leveling base 740 extends along a length of the frame component 704 such that when the panel 102 is positioned on the frame, the leveling base 740 contacts the edge of the panel 102 along the length of the frame component 704, and thus along a length of the edge of the panel 102. In some examples, the length of the leveling base 740 is approximately equal to or greater than the length of at least one of the frame component 704 and the edge of the panel 102. In such examples, a single leveling base 740 may be provided with the frame component. In other examples, the length of the leveling base 740 is less than the length of at least one of the frame component 704 and the edge of the panel 102. In such examples, any desired number of leveling bases 740 may be provided with the frame component 704 including, but not limited to, one leveling base 740, two leveling bases 740, three leveling bases 740, more than three leveling bases 740, or any other desired number of leveling bases 740. In some examples where the length of the leveling base 740 is less than the length of the edge of the panel 102, depending on the number of leveling bases 740 utilized, the entire edge of the panel 102 may or may not be in contact with at least one leveling base 740.

In various examples, the leveling base 740 is vertically adjustable through at least one set screw 742. The set screw 742 may be provided in the front channel 114, although it need not be in other examples. The disclosure of the set screw 742 should not be considered limiting on the current disclosure, as in other examples, the leveling base 740 may be vertically adjusted through various other suitable mechanisms. Optionally, the set screw 742 is retained on a leveling post 744 of the frame component 704, although various other suitable mechanisms may be provided to position the set screw 742 relative to the frame component 704. In certain examples, a plurality of set screws 742 are provided along the front channel 114 such that the leveling base 740 may be adjusted at a plurality of locations. In such examples, the vertical adjustment or position of the leveling base 740 at one location may be the same as or different from the vertical adjustment or position of the leveling base 740 at another location. When a plurality of set screws 742 are included, the set screws 742 may be spaced apart by regular or irregular intervals.

Optionally, a height of the set screw 742 may be limited or predefined such that the leveling base 740 cannot be raised too high relative to the frame component 704. In such examples, the predefined range of vertical adjustment of the set screw and leveling base may prevent the leveling base 740 from being adjusted such that it (and the panel 102) are no longer within the front channel 114. In other examples, the height of the leveling base 740 may be controlled through mechanisms other than set screws while remaining a self-contained level system. For example, leveling mechanisms may include adjustable shims, a setting block, a scissor mechanism, a spindle and glide, a pneumatic system and/or device, a magnetic system, a thread that goes up into frame with a disk on the bottom to adjust for floor, an inflatable device, foam, a magnetic levitation system, pressure expansion devices, offset camming devices, hydraulic devices, shape memory polymers, photopolymers, dialectic elastomers, ionic electroactive polymers, polyelectrolyte gels, gel-metal composites, screws, screw jacks, roller screws, or other suitable devices that can change and control the height of the leveling base 740.

As illustrated in FIGS. 7 and 8, the leveling system 739 is a self-contained level system within the frame rather than being an external or additional component. In addition, because the leveling system 739 is self-contained, it may reduce the number of steps needed for installation (because additional tools and/or steps are not needed), the amount of installation time, and provides greater flexibility for how much the panel can be off the floor compared to traditional and external systems. In certain cases, the self-contained leveling system 739 may reduce the installation time by 20-25% compared to traditional wall systems.

Optionally, the frame component 704 includes a cover 746, such as a top gasket or other suitable device, may be provided between the panel 102 and the frame component 704, and above the leveling base 740. Similarly, the spacer 338 may be provided between the panel 102 and a forward portion of the channel 114.

A method of installing the panel 102 with the frame component 704 includes positioning the panel 102 in the front channel 114 and on the leveling base 740. After the panel 102 is positioned, the method includes vertically adjusting at least one set screw 742 such that a corresponding portion of the panel 102 is vertically positioned. In other examples, the method includes first vertically adjusting at least one set screw 742 to vertically adjust the leveling base 740 to a desired vertical position, and after the leveling base 740 is vertically positioned, positioning the panel 102 on the leveling base.

The frame component 704 with the leveling base 740 may allow for an installer to quickly and easily ensure that the panel 102 is at a correct position (e.g., level) relative to the surface. In addition, the leveling base 740 allows for increased tolerance or variation in the panels 102 compared to traditional systems because leveling base 740 can be adjusted to compensate for any imprecision in the measurement of the panel 102, while also ensuring the panel 102 is at a correct position relative to the surface. Thus, the frame component 704 with the leveling base 740 allows for imprecisely measured panels 102, which would otherwise be discarded in traditional systems, to still be used with the demountable wall system 100. In addition, the increased space provided by the frame component 704 with the leveling base 740 may allow for larger panels 102 to be used compared to traditional systems.

The contact between the leveling base 740 and the panel 102 may also provide improved safety compared to traditional systems. In particular, in traditional systems, the panel 102 only contacts individual shims spaced along the length of the frame, usually two along the entire length of the frame, which presents an opportunity for at least one of the shims and the panel 102 to slip or adjust. In contrast, with the leveling base 740, and in particular when the leveling base 740 extends along the length of the frame component 704, the panel 102 is more securely held in place because of contact along the length of the edge of the panel.

The contact between the leveling base 740 and the panel 102 may also provide an acoustic benefit such that the wall system 100 has improved acoustical performance compared to traditional systems. Without being bound to any particular theory, it is believed that increasing the amount of contact between the panel and the gasket will result in improved acoustic performance. In traditional systems because the panels 102 are typically only supported by two shims on the frame, a gasket on the shims only contacts the panel 102 at those two points. In contrast, with the demountable wall system 100, because the leveling base 740 extends along the length of the frame component, a gasket can be provided on the leveling base 740 that extends along the entire edge, or any desired portion, of the panel 102. In other words, the combination of the gasket and the leveling base 740 has more contact points with the panel 102 thus resulting in improved acoustic performance, such as sound proofing. In some examples, the leveling base 740 that extends along the entire length of the frame component 704 and thus the entire length of the edge may provide the most improved acoustic performance compared to traditional systems.

As one non-limiting example illustrating the improved acoustic performance, a panel 102 may be 0.5 inches thick with an edge that is 48 inches. In a traditional system, a traditional shim is about 2 inches long. Assuming that four shims are used in the traditional system (which is typical), the gasket to edge contact with the traditional system and 0.5-inch glass is 4 square inches of contact (i.e., 2 inches long×0.5 inches thick×4 total shims). In this example, it is estimated that such a traditional system would experience a drop or reduction from the original sound transition coefficient (stc) of the panel 102 of about 3-4 stc. By comparison, with the example of the leveling base 740 that extends along the entire length of the frame component 704, the gasket may have complete contact with the panel along the edge through the leveling base 740, or about 24 square inches of contact (i.e., 48 inches long×0.5 inches thick×1 leveling base). In this example, it is estimated that the drop or reduction of the stc of the panel 102 would experience a drop of up to 2 stc, such as a drop of 1-2 stc. In other words, the contact between the gasket and the edge of the panel 102 in the demountable wall system 100 was six (6) times the amount of contact between the gasket and the edge of the panel in the traditional system, and such contact minimizes or reduces the drop in stc. In other examples, it is expected that the leveling base 740 would minimize or reduce the drop in stc of a panel 102 constructed of any material as compared to traditional systems.

Removable Back Cover

FIGS. 9-12 illustrate another example of a frame component 904 that can be used with the demountable wall system 100.

Similar to the frame component 304, the frame component 904 includes the front cover 332 and the locking slot 334. However, compared to the frame component 304, the key 336 of the front cover 332 and the locking slot 334 have a different profile and are substantially planar.

Compared to the frame components 104, 304, and 704, the frame component 904 also includes a removable back cover 930 that selectively covers or provides access to the back channel 326. In these examples, the back channel 326 can optionally receive the panel 102 within the back channel 326. Moreover, the back cover 930 can be changed and another back cover 930, or a supplemental back cover can be installed.

In some examples, the back cover 930 is removably attached to the frame component 904 through various suitable connecting mechanisms that allow for secure attachment of the back cover 930 to the frame component 904. Suitable mechanisms include, but are not limited to, a sliding connection, a snap-fit connection, hook and loop fasteners, various other types of fasteners, combinations thereof, or various other suitable permanent or non-permanent mechanisms. In some cases, the connecting mechanisms may be any suitable permanent or non-permanent fastening means that apply mechanical, electromechanical, piezoelectric, vacuum, magnetic, and/or friction force to join the back cover 930 to the frame component 904. The permanent or non-permanent fastening means for joining the back cover 930 to the frame component 904 may be the same or may be different from the fastening means that can be used to attach the front cover 332 to the frame component 904. In the present example, and as illustrated in FIGS. 9-14, the connecting mechanisms include at least one engagement piece 948 on the frame component 904 and a complimentary engagement piece 950 on the back cover 930.

In various examples, the back cover 930 with the frame component 904 may be selectively removed and replaced with a different back cover 930 having a different profile, a different shape, etc. The front cover 332 can similarly be removed and replaced with a different front cover 332 having a different profile, a different shape, etc. For example, compared to the back cover 930 and front cover 332 of FIGS. 9 and 10, the back cover 930 of FIG. 11 has a 3D or textured pattern on all visible faces of the back cover 930 and the front cover 332 has a 3D or textured pattern on a side face of the front cover 332. As a further example, compared to the back cover 930 and the front cover 332 of FIGS. 9 and 10, the back cover 930 of FIG. 12 has a 3D or textured pattern on select visible faces of the back cover 930 (e.g., in FIG. 11, the 3D pattern is not on the top visible face) and the front cover 332 has a 3D or textured pattern on a side face of the front cover 332. As another example, compared to the back cover 930 and the front cover 332 of FIGS. 9 and 10, the back cover 930 of FIG. 13 has a 3D or textured pattern and a different profile (e.g., asymmetrical or any other shape). In some examples, the shape and/or profile of the front cover 332 may match the shape and/or profile of the back cover 930, although they need not. Various other types of profiles, shapes, etc. may be provided with the back cover 930, and the back covers 930 illustrated in FIGS. 9-13 should not be considered limiting on the current disclosure.

Supplemental Channel

Figure 14:
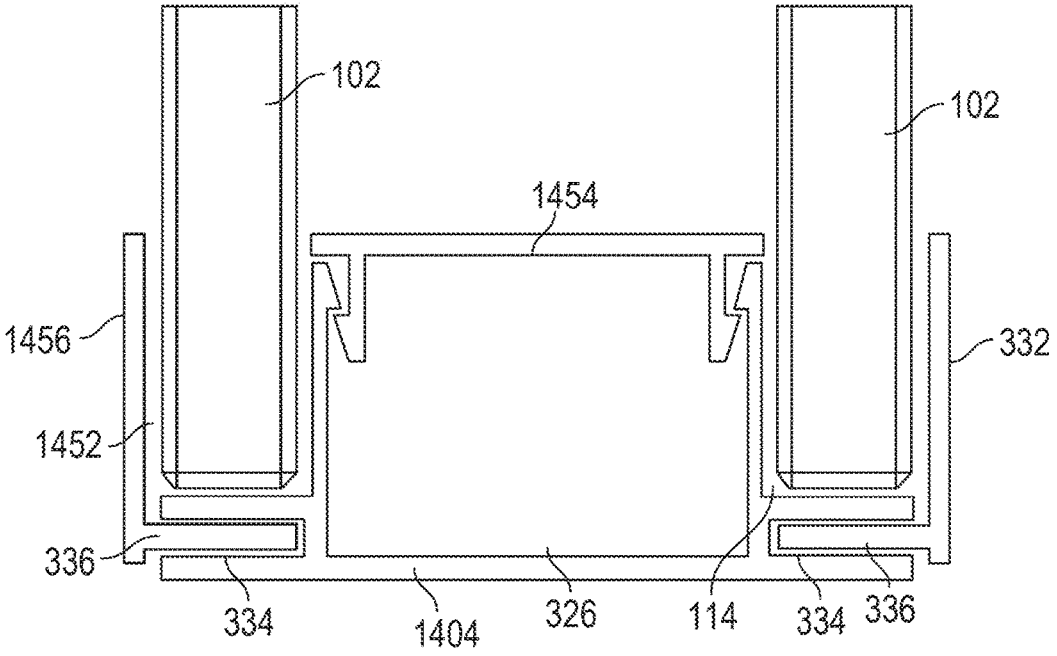
FIG. 14 is a side view of a frame component of a demountable wall system with two panels, and the frame component includes two channels according to aspects of the present disclosure.

FIG. 14 illustrates another example of a frame component 1404 that can be used with the demountable wall system 100. As illustrated, compared to the frame components 104, 304, 704, and 904, the frame component 1404 includes a supplemental channel 1452 such that the frame component 1404 can accommodate two panels 102. In such examples, the frame component 1404 is a universal base that can accommodate both a single panel and a double panel installation. Referring to FIG. 14, it will be appreciated that in certain examples, the components illustrated between the supplemental channel 1452 and the front channel 114 (e.g., the channel 326, a face cover 1454, etc.) may be omitted. Stated differently, in some examples, the back channel 326 may be omitted, and the demountable wall system 100 includes the frame component 1404 with the supplemental channel 1452 and the front channel 114.

In some examples, the supplemental channel 1452 is substantially similar to the front channel 114 and includes the locking slot 334 for receiving a supplemental cover 1456. In some cases, the supplemental cover 1456 is substantially similar to the front cover 332, although it need not be in other examples. Optionally, the supplemental cover 1456 and the front cover 332 of the demountable wall system 100 may include spacers (not shown), such as wedge gaskets or other suitable mechanisms. The spacer (not shown) may be positioned between the supplemental and front covers 332 and 1456, respectively, and the panels 102 such that they apply cantilevered pressure to the supplemental and front covers 332 and 1456 such that the supplemental and front covers 332 and 1456 are held in place.

A method of assembling the demountable wall system 100 with the frame component 1404 includes securing the frame component 1404 to a floor or other surface with a fastener. The method includes positioning a first panel 102 in the front channel 114 and positioning the front cover 332 on the frame component 1404. The method optionally includes positioning the face cover 1454 on the frame component 1404. The method may include positioning a second panel 102 in the channel 1452 and positioning the supplemental cover 1456 on the frame component 1404 to cover the channel 1452.

Joining System

FIGS. 16-22 illustrate an example of two frame components 1604A-B that can be used with the demountable wall system 100. As illustrated, a joining system 1658 joins the two frame components 1604A-B together and at any angle as desired in the demountable wall system.

In some cases, the frame components 1604A-B each include an internal central receptacle 1660. The receptacle 1660 is shaped to receive outer edges of a suitable fastener, as discussed in more detail below. In some examples, a back channel (e.g., such as the back channel 326) may be the receptacle 1660, although it need not be in other examples. For the embodiments where the frame components 1604A-B are joined to form a corner, ends 1662 of two frame components 1604A-B may be cut at mating angles to each other to form a 90-degree corner or other angled corner as desired.

The joining system 1658 includes a fastening mechanism to join the frame components 1604A-B together. Suitable fastening mechanisms include, but are not limited to any suitable permanent or non-permanent fastening means that apply mechanical, electromechanical, piezoelectric, vacuum, magnetic, and/or friction force may be used. Examples of mechanical fastening means include but are not limited to snap-fit, hook and loop, snaps, clasps, nuts and bolts, screws, pins and rivets, cams, and ratchets. Examples of vacuum fasteners may include but are not limited to suction cups and the like. Examples of magnetic fasteners may include but are not limited to hidden fasteners that can be turned through application of a magnetic field (such as those described in http://swissinvis.com/products/). Examples of additional fastening means may include but are not limited to gravity, crimping, welding, soldering, brazing, taping, gluing, cementing, riveting, magnets, electromagnets, camming, spring closures, snap-fit, hinges, friction lock systems, hook and loop fasteners, dual lock fasteners, zippers, clinching, thermodynamic materials, elastic materials, wedge locking, the use of other adhesives, or various other fastening mechanisms. In some examples, and to facilitate fastening of these two frame components 1604A-B, the fastening mechanism may be incorporated into one or both frame components 1604A-B.

Figure 20:
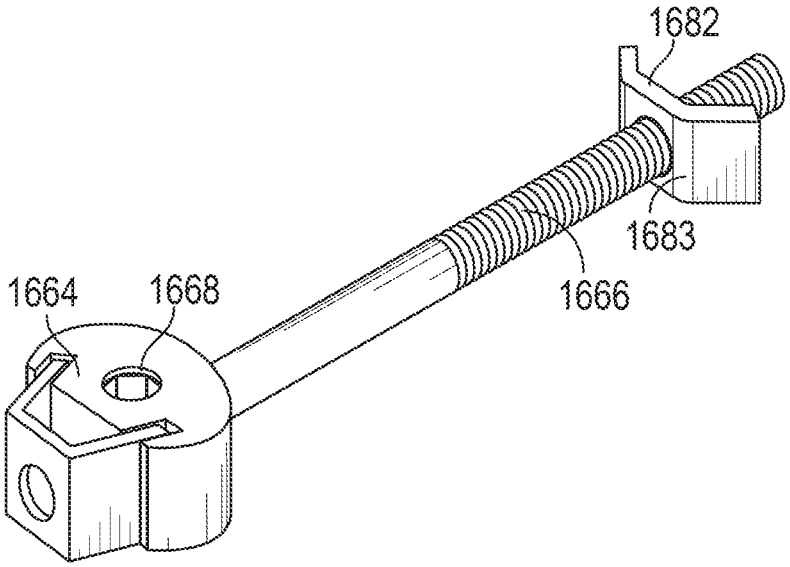
FIG. 20 is a perspective view of fasteners of the joining system of FIG. 16.
Figure 21:
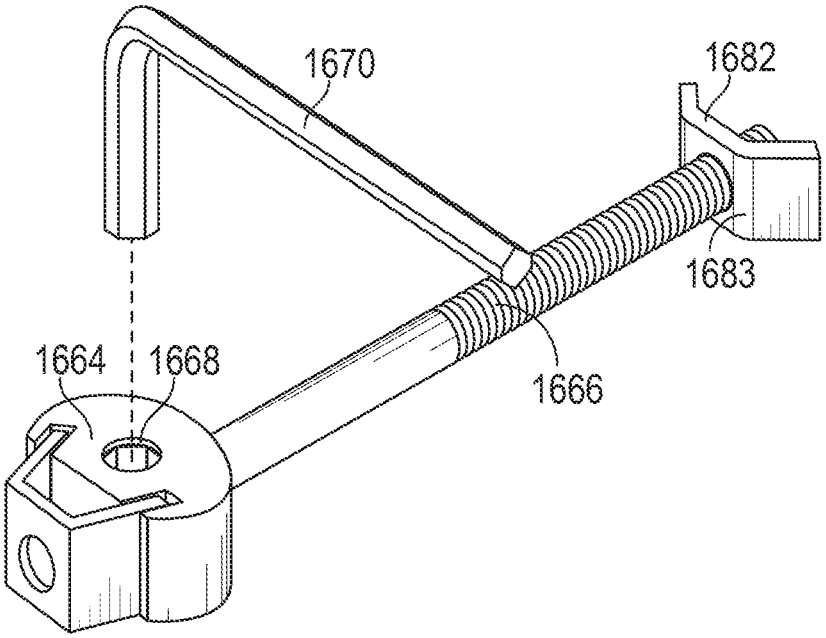
FIG. 21 is a perspective view of the fasteners of the joining system of FIG. 17 and an adjustment tool.
Figure 22:
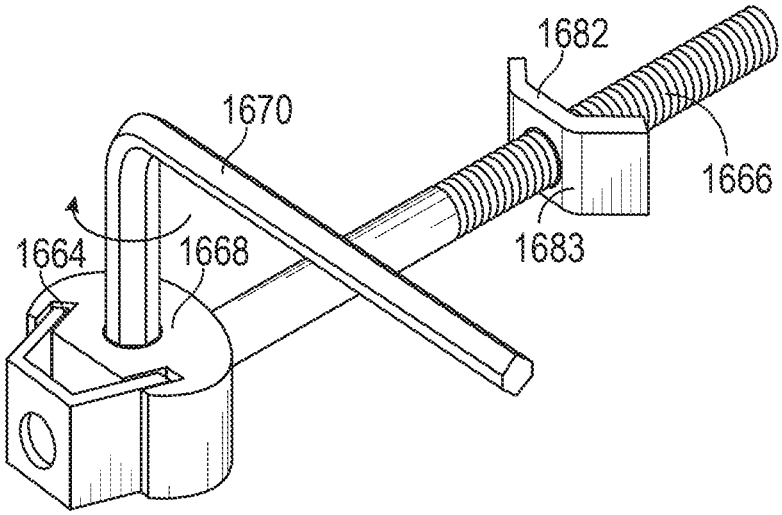
FIG. 22 is another perspective view of the fasteners and adjustment tool of the joining system of FIG. 17.

In the example of FIGS. 16-22, the fastening mechanism of the joining system 1658 includes a first fastener 1664 and a second fastener 1666. In some cases, the first fastener 1664 and second fasteners 1666 are drawing or cam fasteners. As best illustrated in FIGS. 20 and 21, the first fastener 1664 may include an interfacing surface 1668 that is engageable with an adjustment tool 1670. In some embodiments, the first fastener 1664 is positioned within an interior location, such as an open channel 1672, of the frame components 1604A. In some cases, the open channel 1672 may optionally be at least one of the front channel 114 and the supplemental channel 1452, although it need not be in other examples. the first fastener 1664 may be attached to the interior location of the frame component 1604A to limit unintended movement of the first fastener 1664 along the open channel 1672.

Optionally, an access portal 1674 may be formed in one or both of the frame components 1604A-B that provides access to the first fastener 1664 within the open channel 1672. The access portal 1674 may be formed in an interior side 1676, an exterior side, top, or other location. The adjustment tool 1670 may be inserted through an access portal 1674 to engage with the interfacing surface 1668. However, in other embodiments, the adjustment tool 1670 may not need to physically engage with the interfacing surface 1668. The adjustment tool 1670 may include a wrench, screwdriver, drill, ratchet mechanism, or other suitable tool.

In some embodiments, an end 1678 of the second fastener 1666 may be engaged with the receptacle 1660 in the frame component 1604B. In some embodiments, the end 1678 includes one or more extensions that selectively engage with the receptacle 1660 to prevent the second fastener 1666 from rotating when the first fastener 1664 is adjusted, thereby allowing the first fastener 1664 to induce a movement of the second fastener 1666 relative to the location of the first fastener 1664. In other words, the first fastener 1664 may be rotated by the adjustment tool 1670, and this rotation causes the second fastener 1666 to move towards or away from the first fastener 1664, depending on the direction of rotation of the first fastener 1664.

In further embodiments, a third fastener 1682, including but not limited to the fasteners described in WO2014/005173, as well as any type of drawing or cam fastener may be coupled to an opposing end 1680 of the second fastener 1666, and this third fastener 1682 engages with the corresponding receptacle 1660 in the frame component 1604B. In some embodiments, the third fastener 1682 includes one or more extensions or wings 1683 that selectively engage with the receptacle 1660.

In certain embodiments, once the second fastener 1666 (or third fastener 1682) is engaged with the receptacle 1660 of the frame component 1604A, the first fastener 1664 may be adjusted in a manner that causes the second fastener 1666 to be pulled in the direction of the first fastener 1664. By doing so, the ends of the frame components 1604A-B are brought into close proximity with each other and into a snug joint.

Figure 28:
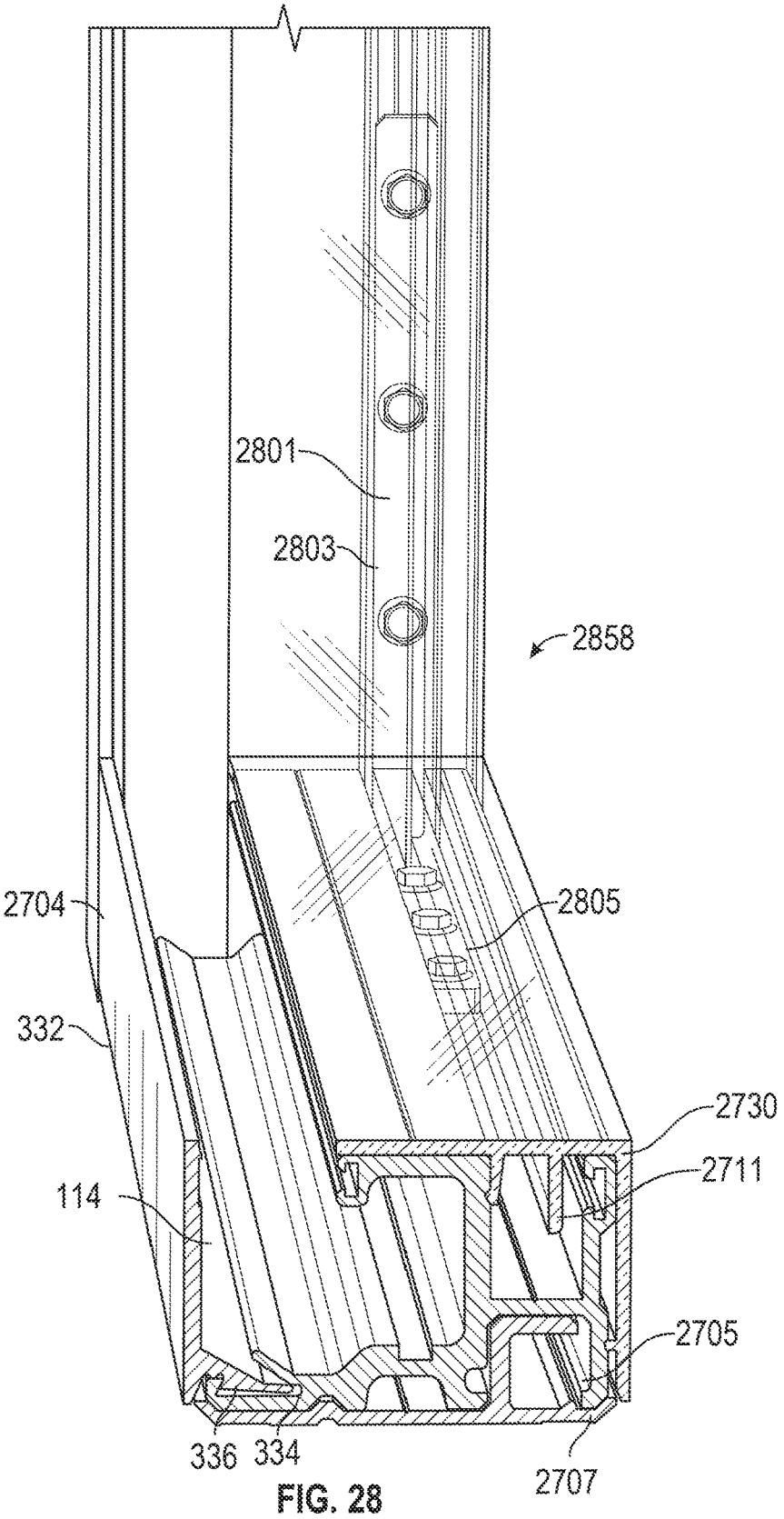
FIG. 28 is another perspective view of the frame component of FIG. 27.

FIG. 28 illustrates another example of a joining system 2858 for frame components. Compared to the joining system 1658, the joining system 2858 includes a bracket 2801 having a first arm 2803 and a second arm 2805. In this example, the bracket 2801 is positioned within the back channel 326 defined by a frame component 2704 and covered by a back cover 2730.

Door Support System

As described above with reference to FIG. 1, in some examples, the demountable wall system 100 includes the door 108 that is capable of moving (e.g., sliding) into place in front of the opening 106. FIGS. 23-26B illustrate an example of a door support system 2388 for the door 108 of the demountable wall system 100.

Figure 23:
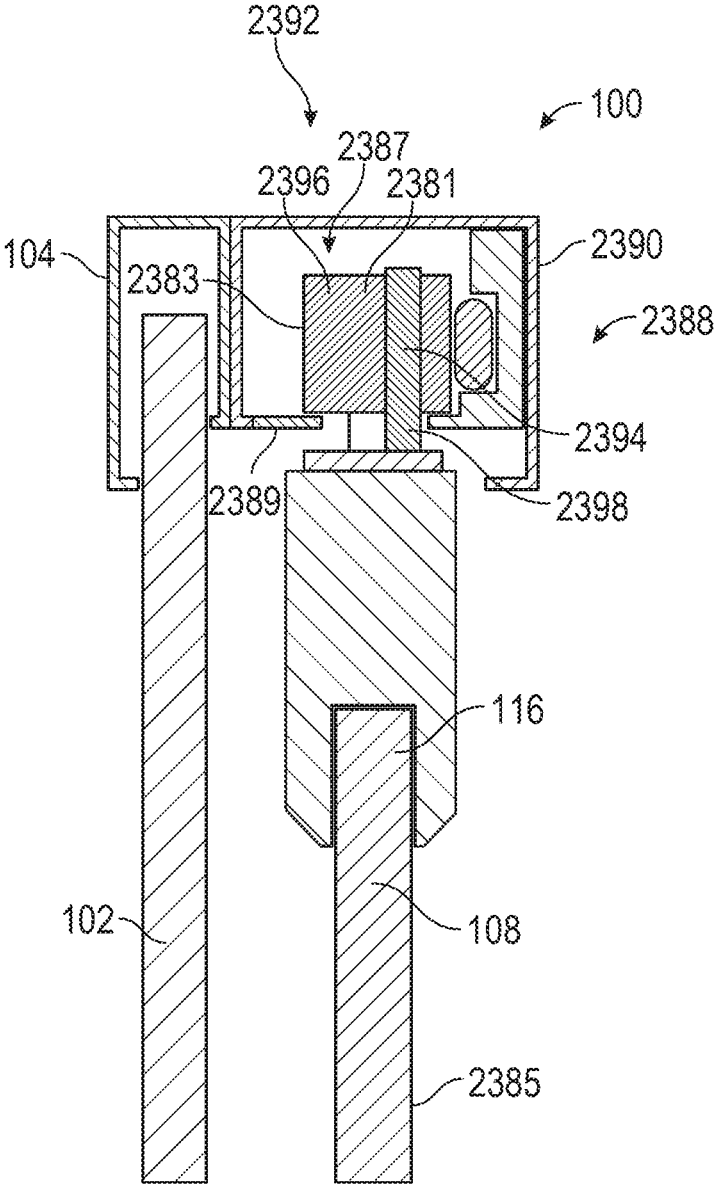
FIG. 23 is a sectional view of a demountable wall system with a frame component and a door support system that supports a door according to aspects of the present disclosure.

As illustrated in FIG. 23, the door support system 2388 includes a track 2390 and a bracket system 2392. In some examples, the track 2390 is attached to the upper portion 116 or the lower portion 118 of the door 108. The track 2390 may be positioned on at least one of the floor and the ceiling of the opening 106 and has a length that allows the door 108 to slide between the closed position (see, e.g., FIG. 26B) and the open or retracted position (see, e.g., FIG. 1 and FIG. 26A).

In some examples, the bracket system 2392 includes one or more brackets 2394 that are attached the upper portion 116 of the door 108 when the door 108 is suspended from the track 2390 mounted in the ceiling of the opening 106. In other examples, one or more brackets 2394 attached to the lower portion 118 of the door 108, to both the upper portion 116 and the lower portion 118, or various other suitable locations. In further embodiments, one or more of the brackets 3294 may extend substantially along an entire width of the door 108. The one or more brackets 2394 are attached to the track 2390 using any suitable fastening means that allows the door 108 to slide between retracted and closed/engaged positions. Such fastening means may include but are not limited to rollers, ball bearings, springs, cables, magnetic connections, electro-mechanical connections, camming retraction mechanisms, modified slide track, pneumatic connections, and hydraulic connections, or various other suitable fastening means. Each bracket 2394 may include a track roller 2396 positioned on an end opposite a location where the bracket 2394 is attached to the door 108. The bracket 2394 includes a neck 2398 that extends away from the door 108 and connects to at least the track roller 2396. Each track roller 2396 may be positioned on the bracket 2394 so that a circumferential surface 2381 of the track roller 2396 is positioned facing the door 108 and a planar surface 2383 of the track roller 2396 is positioned substantially parallel to the door's majority surface plane 2385.

Figure 24:
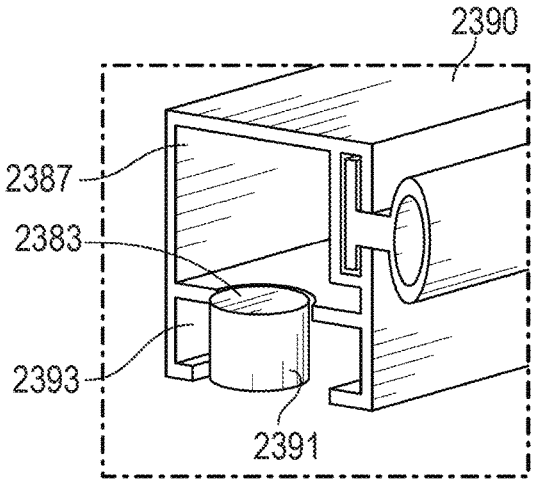
FIG. 24 is a perspective view of a portion of the door support system of FIG. 23.

As illustrated in FIG. 24, the track 2390 may include a receptacle 2387 that is shaped to receive the track rollers 2396. The receptacle 2387 may be partially enclosed by a pair of lips 2389 that are shaped to receive the neck 2398 of the bracket 2394. These track rollers 2396 may have a sufficient thickness that allows the track rollers 2396 to be retained within the track 2390 by the lips 2389. The track rollers 2396 are configured to travel along the surface of the receptacle 2387 that is positioned below the track rollers 2396 as the door 108 slides between the closed position and the retracted position. In some embodiments, this surface may be the pair of lips 2389 when the lips 2389 form the lower surface of the receptacle 2387. In other embodiments, the pair of lips 2389 may form a side or an upper surface of the receptacle 2387.

Figure 26A:
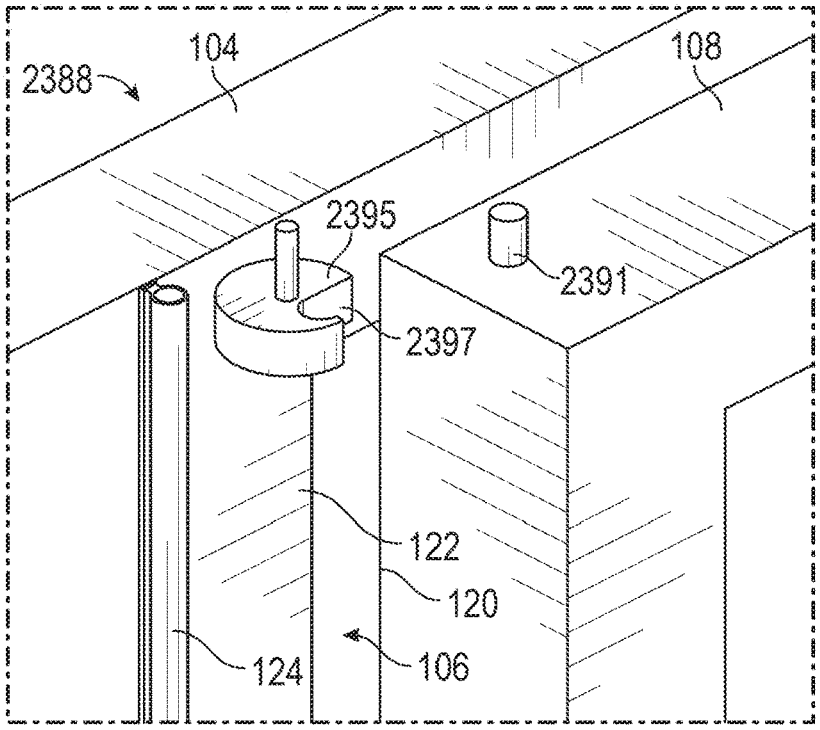
FIG. 26A is a partial perspective view of the demountable wall system of FIG. 23 with the door in an unengaged position.
Figure 26B:
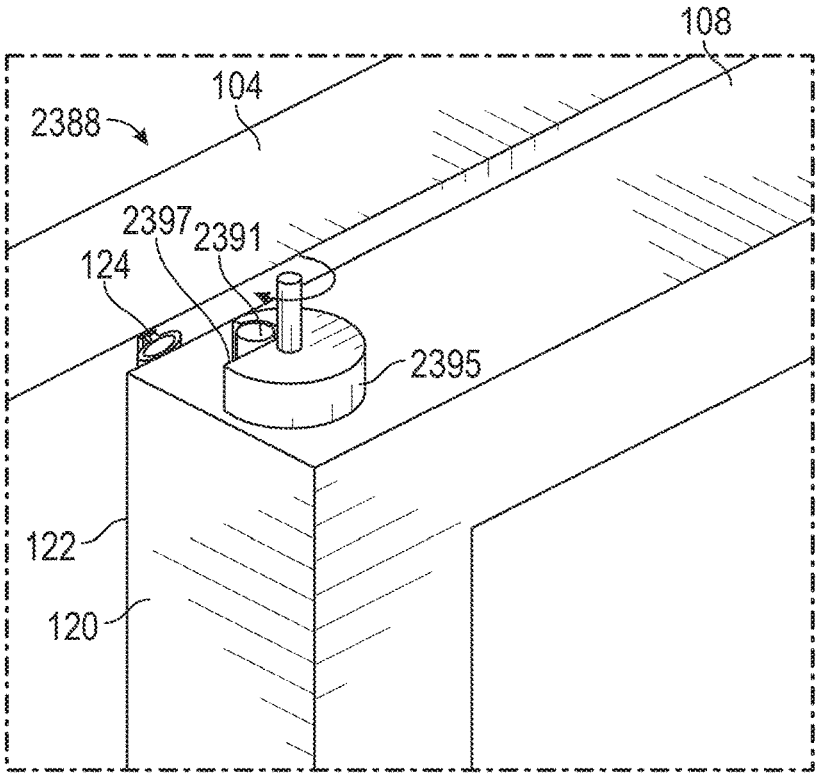
FIG. 26B is a partial perspective view of the demountable wall system of FIG. 23 with the door in an engaged position.

To provide additional privacy and sound control, the door 108 may be configured to transition from a nearly closed position in front of the opening 106, as shown in FIG. 26A, to an engaged position where the door 108 is positioned within the opening 106 or pressed tightly against the opening, as shown in FIG. 26B. To facilitate movement into the engaged position, each bracket 2394 may include at least one engaging roller 2391 that is positioned between the track roller 2396 and the door 108. The engaging roller 2391 may be oriented substantially perpendicular to the track roller 2396 such that a planar surface 2383 of the track roller 2396 is positioned substantially perpendicular to the door's majority surface plane 2385. The bracket 2394 can then be attached to the track 2390 by any suitable design or configuration, such that the engaging roller 2391 may be used that does not interfere with the operation of the conventional door sliding mechanism.

Figure 25A:
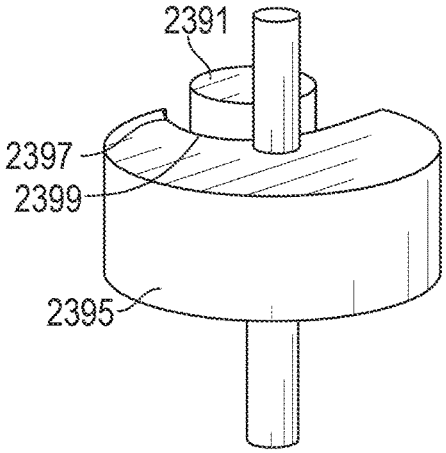
FIG. 25A is a perspective view of a portion of the door support system of FIG. 23 in a first position.
Figure 25B:
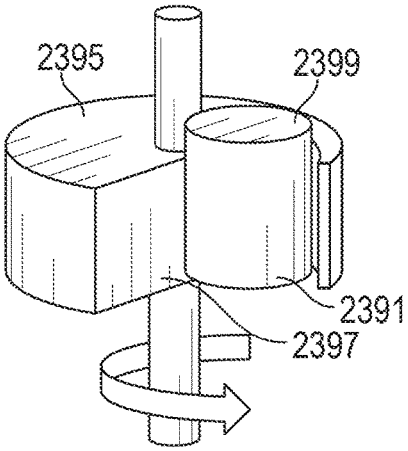
FIG. 25B is a perspective view of the portion of FIG. 25A in a second position.

In these embodiments, the track 2390 may include an additional area 2393 that is shaped to receive the engaging rollers 2391. These engaging rollers 2391 pass through the additional area 2393 as the door 108 moves along the track 2390. At the location where the door 108 reaches the closed position, as illustrated in FIG. 26A, one or more offset turn mechanisms 2395 may be positioned adjacent some or all of the engaging rollers 2391. The offset turn mechanisms 2395 may include a cutout region 2397 that is shaped to conform to a portion of the circumferential surface of the engaging rollers 2391. When the door 108 reaches the closed position, as illustrated in FIGS. 24, 25A, and 26A, the engaging rollers 2391 contact a leading edge 2399 of the cutout region 2397, which causes the offset turn mechanisms 2395 to rotate about their axes. As the offset turn mechanisms 2395 rotate, as illustrated in FIGS. 25B and 26B, the engaging rollers 2391 are pulled about an arcuate path of the cutout region 2397 until the engaging rollers 2391 reach a position approximately 180 degrees from the position where the engaging rollers 2391 first contacted the offset turn mechanisms 2395 in the closed position. The offset turn mechanisms 2395 are configured to cease rotation once the engaged position is reached, as shown by the position illustrated in FIGS. 25B and 26B, and the door 108 has been pulled into the opening 106 by the rotational movement of the offset turn mechanisms 2395.

In other embodiments, instead of an arcuate motion, a perpendicular track may be located at the position where the door 108 reaches the closed position, and the door 108 may transition by allowing the engaging rollers 2391 to move along this perpendicular track to position the door 108 in the engaged position. In yet other embodiments, the track rollers 2396 may have a spherical shape, similar to that of a ball bearing that is able to transition between the track 2390 and the offset turn mechanisms 2395 or perpendicular track without the need for an additional engaging roller 2391.

In further embodiments, a handle (not shown) may be used in place of the offset turn mechanisms 2395 and engaging roller 2391. However, any suitable releasable mechanism that allows the door to be pressed against or within the opening 106 may be used. By inclusion of the translational movement mechanism, the sliding door mechanism attains improved acoustic properties over conventional sliding doors that do not include an additional engaged position. In addition, by using a 90-degree turning mechanism at the end of the track 2390, the depth of travel needed by the door 108 is minimized.

Figure 27:
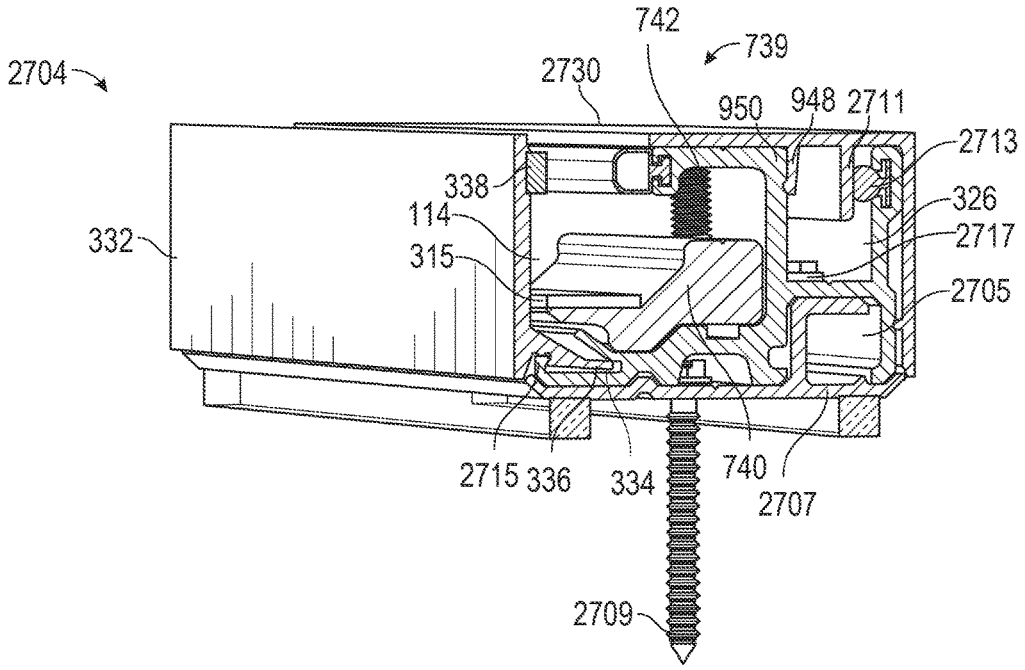
FIG. 27 is a perspective view of a frame component for a demountable wall system according to aspects of the present disclosure.

FIGS. 27 and 28 illustrate another example of a frame component 2704 that can be used with the demountable wall system 100. In various examples, the frame component 2704 may be used as both a top frame component and a bottom frame component of the demountable wall system.

Similar to the frame component 304, the frame component 2704 includes the front channel 114 and the back channel 326. Compared to the frame component 304, the frame component 2704 includes additional channels. For example, as illustrated in FIGS. 27 and 28, in addition to the front channel 114 and back channel 326, the frame component 304 defines a track channel 2705 that at least partially accommodates an alignment track 2707 of the frame component 2704. In various cases, the alignment track 2707 may be pre-installed on a surface through various suitable mechanical or chemical fasteners (screws 2709 are illustrated in FIG. 27), and the frame component 2704 may be installed on the track 2702. In these examples, the alignment track 2707 may allow for the type or configuration of the frame component to be changed as desired. Optionally, various suitable connectors 2717 may selectively connect the frame component 2704 with the alignment track 2707.

The frame component 2704 also includes a back cover 2730 that is substantially similar to the back cover 930 except that the back cover 2730 further includes a locking projection 2711. When the back cover 2730 is assembled with the frame component 2704, a biasing gasket 2713 (or other suitable device) engages the locking projection 2711 and biases the locking projection 2711 away from the biasing gasket 2713. In various examples, the engagement between the biasing gasket 2713 and the locking projection 2711 maintains or promotes engagement between the engagement pieces 948, 950 (or other connecting mechanisms connecting the back cover 2730 and the frame component 2704).

As illustrated in FIGS. 27 and 28, similar to the frame component 704, the frame component 2704 also includes the leveling system 739 with the leveling base 740. As best illustrated in FIG. 27, in this example, the sealing gasket 315 is provided on the leveling base 740 such that a seal can be formed between the leveling base 740 and the panel positioned on the leveling base 740.

Similar to the frame component 304, the frame component 2704 also defines the locking slot 334 that selectively receives the key 336 of the front cover 332. Compared to the frame component 304, the profile of the locking slot 334 of the frame component 2704 progressively decreases in height. In some examples, the decreasing height of the locking slot 334 may facilitate the guidance, positioning, and retention of the key 336 within the locking slot 334. In various examples, and compared to the frame component 304, the frame component 2704 also includes a key lock 2715. In certain aspects, and as best illustrated in FIG. 27, the key lock 2715 selectively engages the key 336 when the key 336 is positioned within the locking slot 334. In certain aspects, the key lock 2715 restricts or prevents purely horizontal movement of the key 336 within the locking slot 334. In various aspects, the key lock 2715 also engages the front cover 332 such that the front cover 332 is pivotable on the key lock 2175.

In some examples, the frame component 2704 includes a covering member 2719 such as foam, various plastics, rubbers, composites, etc. under the frame component 2704 and/or under the alignment track 2707. In some cases, the covering member 2719 may further compensate for any variations in the surface on which the frame component 2704 is installed.

It will be appreciated that although various features are described separately with respect to the demountable wall systems 100, various other demountable wall systems may include various combinations or sub-combinations of the various features disclosed. For example, the features of the frame components 104, 304, 704, 904, 1404, 1504, 1604, and 2704 may be used in various combinations to form new frame components, and/or any of the aforementioned frame components may be used in various combinations in a single wall system. Various other demountable wall systems may include various other combinations or sub-combinations of features as desired.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A demountable wall system comprising: a frame component comprising a base, the base comprising a front edge, a back edge opposite from the front edge, and a divider extending from a top surface of the base between the front edge and the back edge, wherein the frame component defines a front channel between the divider and the front edge and a back channel between the divider and the back edge, wherein the front channel is configured to receive a panel, wherein the front edge defines a locking slot that is configured to removably connect to a front cover that covers the front channel at the front edge, and wherein the back channel is configured to removably connect to a supplementary component.

EC 2. The demountable wall system of any of the preceding or subsequent example combinations, wherein the supplementary component is a back cover, and wherein the back cover encloses the back channel when removably connected to the frame component.

EC 3. The demountable wall system of any of the preceding or subsequent example combinations, further comprising the front cover, and wherein a profile of the front cover is different from the profile of the back cover.

EC 4. The demountable wall system of any of the preceding or subsequent example combinations, wherein the back channel is configured to removably connect to the supplementary component through a snap-fit connection.

EC 5. The demountable wall system of any of the preceding or subsequent example combinations, wherein the back channel is configured to receive a panel, wherein the back edge defines a locking slot that is configured to removably connect to a back cover that covers the back channel at the back edge.

EC 6. The demountable wall system of any of the preceding or subsequent example combinations, wherein the divider is a first divider, wherein the frame component further comprises a second divider extending from the top surface between the first divider and the back edge, and wherein the back channel is defined between the second divider and the back edge.

EC 7. The demountable wall system of any of the preceding or subsequent example combinations, wherein the frame component further defines an intermediate channel between the first divider and the second divider, and wherein the intermediate channel is configured to removably connect to a second supplementary component.

EC 8. The demountable wall system of any of the preceding or subsequent example combinations, wherein the second supplementary component is a face cover.

EC 9. The demountable wall system of any of the preceding or subsequent example combinations, wherein the locking slot is defined in the front edge between the top surface of the base and a bottom surface of the base.

EC 10. The demountable wall system of any of the preceding or subsequent example combinations, wherein the locking slot comprises a profile that is complimentary to a profile of a key of the front cover.

EC 11. A demountable wall system comprising: a frame component comprising a base, the base comprising: a front edge defining a front locking slot; a back edge opposite from the front edge and defining a back locking slot; a divider extending from a top surface of the based between the front edge and the back edge; a front channel between the divider and the front edge; and a back channel between the divider and the back edge, wherein the front channel and the back channel are each configured to receive a panel, wherein the front locking slot is configured to removably connect to a front cover that covers the front channel at the front edge, and wherein the back locking slot is configured to removably connect to a back cover that covers the back channel at the back edge.

EC 12. The demountable wall system of any of the preceding or subsequent example combinations, further comprising the front cover, wherein the front cover comprises a key that is selectively positionable within the front locking slot to removably connect the front cover to the frame component.

EC 13. The demountable wall system of any of the preceding or subsequent example combinations, wherein a profile of the key is complimentary to a profile of the front locking slot.

EC 14. The demountable wall system of any of the preceding or subsequent example combinations, further comprising the back cover, wherein the back cover comprises a key that is selectively positionable within the back locking slot to removably connect the back cover to the frame component.

EC 15. The demountable wall system of any of the preceding or subsequent example combinations, wherein the divider is a first divider, wherein the frame component further comprises a second divider extending from the top surface between the first divider and the back edge, and wherein the back channel is defined between the second divider and the back edge.

EC 16. The demountable wall system of any of the preceding or subsequent example combinations, wherein the frame component further defines an intermediate channel between the first divider and the second divider, and wherein the intermediate channel is configured to removably connect to a second supplementary component.

EC 17. A method of assembling a demountable wall system, the method comprising: assembling a panel with a frame component, wherein the frame component comprises a base comprising a front edge, a back edge opposite from the front edge, a divider extending from a top surface of the base between the front edge and the back edge, a front channel between the divider and the front edge, a back channel between the divider and the back edge, and a locking slot at the front edge, and wherein assembling the panel comprises positioning the panel within the front channel; removably connecting a front cover with the frame component by engaging the front cover with the locking slot such that the front cover covers the front channel at the front edge; and removably connecting a supplementary component to the back channel.

EC 18. The method of any of the preceding or subsequent example combinations, wherein the supplementary component is a back cover, and wherein removably connecting the back cover comprises enclosing the back channel with the back cover.

EC 19. The method of any of the preceding or subsequent example combinations, wherein the front cover comprises a key, and wherein removably connecting the front cover comprises positioning the key of the front cover within the locking slot.

EC 20. The method of any of the preceding or subsequent example combinations, wherein the frame component further defines a back locking slot at the back edge, wherein the supplementary component is a back cover comprising a key, and wherein removably connecting the back cover comprises positioning the key of the back cover within the back locking slot.

EC 21. A demountable wall system comprising: a frame component defining a front channel; and a leveling base within the front channel and comprising a support surface, wherein the leveling base is vertically positionable within the front channel through at least one adjustment mechanism such that a vertical position of the support surface within the front channel is controlled, and wherein the frame component is configured to support a panel within the front channel and on the leveling base.

EC 22. The demountable wall system of any of the preceding or subsequent example combinations, wherein the at least one adjustment mechanism comprises a set screw retained on a leveling post of the frame component, wherein the set screw is threadably engaged with the leveling base, and wherein the leveling post is within the front channel.

EC 23. The demountable wall system of any of the preceding or subsequent example combinations, wherein the leveling base is vertically positionable between a lowest position and a highest position, and wherein, in both the lowest position and the highest position, the support surface is within the front channel.

EC 24. The demountable wall system of any of the preceding or subsequent example combinations, wherein the at least one adjustment mechanism is a first adjustment mechanism at a first position along a length of the leveling base, and wherein the demountable wall system further comprises a second adjustment mechanism at a second position along the length of the leveling base.

EC 25. The demountable wall system of any of the preceding or subsequent example combinations, wherein the first adjustment mechanism and the second adjustment mechanism are independently adjustable.

EC 26. The demountable wall system of any of the preceding or subsequent example combinations, wherein the support surface comprises a spacer, and wherein the frame component is configured to support the panel within the front channel and on the spacer.

EC 27. The demountable wall system of any of the preceding or subsequent example combinations, wherein a length of the leveling base is approximately equal to a length of the frame component.

EC 28. A method of installing a panel on a frame of a demountable wall system comprising: positioning the panel in a front channel defined by a frame component of the frame and on a support surface of a leveling base within the front channel; and vertically positioning at least one portion of the panel by controlling at least one adjustment mechanism to vertically adjust at least one portion of the leveling base within the front channel relative to the frame component.

EC 29. The method of any of the preceding or subsequent example combinations, wherein the at least one adjustment mechanism comprises a set screw retained on a leveling post of the frame component, wherein the leveling post is within the front channel, wherein the set screw is threadably engaged with the leveling base, and wherein controlling the at least one adjustment mechanism comprises rotating the set screw on the leveling post.

EC 30. The method of any of the preceding or subsequent example combinations, wherein the at least one adjustment mechanism is a first adjustment mechanism, the at least one portion of the panel is a first portion of the panel, and the at least one portion of the leveling base is a first portion of the leveling base, and wherein the method further comprises: vertically positioning a second portion of the panel by controlling a second adjustment mechanism to vertically adjust a second portion of the leveling base within the front channel relative to the frame component.

EC 31. The method of any of the preceding or subsequent example combinations, wherein vertically positioning the second portion of the panel comprises controlling the second adjustment mechanism such that a vertical position of the second portion of the panel is the same as a vertical position of the first portion of the panel.

EC 32. The method of any of the preceding or subsequent example combinations, wherein vertically positioning the second portion of the panel comprises controlling the second adjustment mechanism such that a vertical position of the second portion of the panel is different from a vertical position of the first portion of the panel.

EC 33. The method of any of the preceding or subsequent example combinations, wherein the panel comprises at least one edge, and wherein positioning the panel in the front channel comprises positioning the at least one edge of the panel on the support surface of the leveling base.

EC 34. The method of any of the preceding or subsequent example combinations, wherein the at least one edge comprises a length, and wherein positioning the at least one edge of the panel on the support surface of the leveling base comprises contacting the support surface of the leveling base with the at least one edge along the length of the at least one edge.

EC 35. A method of installing a panel on a frame of a demountable wall system comprising: vertically positioning a leveling base within a front channel defined by a frame component of the frame by adjusting at least one adjustment mechanism to vertically adjust at least one portion of the leveling base; and positioning the panel on a support surface of the leveling base within the front channel.

EC 36. The method of any of the preceding or subsequent example combinations, wherein the at least one adjustment mechanism comprises a set screw retained on a leveling post of the frame component, wherein the leveling post is within the front channel, wherein the set screw is threadably engaged with the leveling base, and wherein controlling the at least one adjustment mechanism comprises rotating the set screw on the leveling post.

EC 37. The method of any of the preceding or subsequent example combinations, wherein the at least one adjustment mechanism is a first adjustment mechanism and the at least one portion of the leveling base is a first portion of the leveling base, and wherein the method further comprises: vertically positioning the leveling base before positioning the panel by controlling a second adjustment mechanism to vertically adjust a second portion of the leveling base within the front channel relative to the frame component.

EC 38. The method of any of the preceding or subsequent example combinations, wherein vertically positioning the leveling base comprises controlling the second adjustment mechanism such that a vertical position of the second portion of the leveling base is the same as a vertical position of the first portion of the leveling base.

EC 39. The method of any of the preceding or subsequent example combinations, wherein vertically positioning the leveling base comprises controlling the second adjustment mechanism such that a vertical position of the second portion of the leveling base is different from a vertical position of the first portion of the leveling base.

EC 40. The method of any of the preceding or subsequent example combinations, wherein the panel comprises at least one edge having a length, and wherein positioning the panel in the front channel comprises positioning the at least one edge of the panel on the support surface of the leveling base and contacting the support surface of the leveling base with the at least one edge along the length of the at least one edge.

EC 41. A demountable wall system comprising: a frame component comprising a base, the base comprising a front edge, a back edge opposite from the front edge, and a divider between the front edge and the back edge, wherein the frame component defines a front channel between the divider and the front edge, wherein the front channel comprises a channel surface, and wherein the frame component defines a locking slot in the front edge between the channel surface and a bottom surface of the base; and a front cover comprising a key, wherein a profile of the key is complimentary to a profile of the locking slot, and wherein the key is removably positionable within the locking slot such that the front cover covers the front channel at the front edge.

EC 42. The demountable wall system of any of the preceding or subsequent example combinations, further comprising a spacer positioned on the front cover between the key and a top end of the front cover and within the front channel.

EC 43. The demountable wall system of any of the preceding or subsequent example combinations, wherein the spacer is unsecured on the front cover.

EC 44. The demountable wall system of any of the preceding or subsequent example combinations, wherein the spacer is monolithically formed with the front cover.

EC 45. The demountable wall system of any of the preceding or subsequent example combinations, wherein the frame component further comprises a back channel between the divider and the back edge, and wherein the demountable wall system further comprises a back cover covering the back channel.

EC 46. The demountable wall system of any of the preceding or subsequent example combinations, wherein the locking slot extends continuously along a length of the frame component.

EC 47. The demountable wall system of any of the preceding or subsequent example combinations, wherein the key extends continuously along a length of the front cover.

EC 48. The demountable wall system of any of the preceding or subsequent example combinations, wherein the locking slot is a first locking slot, and wherein the frame component comprises a plurality of locking slots spaced apart along a length of the frame component.

EC 49. The demountable wall system of any of the preceding or subsequent example combinations, wherein the key is a first key, and wherein the front cover comprises a plurality of keys spaced apart along a length of the front cover.

EC 50. The demountable wall system of any of the preceding or subsequent example combinations, wherein the key is removably positionable within the locking slot such that the key is engaged with the locking slot and a purely horizontal force in a direction parallel to the bottom surface of the base does not dislodge the key from the locking slot.

EC 51. A method of installing a panel on a frame of a demountable wall system comprising: positioning the panel in a front channel defined by a frame component of the frame, wherein the frame component comprises a base, the base comprising a front edge, a back edge opposite from the front edge, and a divider between the front edge and the back edge, wherein the frame component defines the front channel between the divider and the front edge, wherein the front channel comprises a channel surface, and wherein the frame defines a locking slot in the front edge between the channel surface and a bottom surface of the base; and inserting a key of a front cover into a locking slot defined by the frame component such that the front cover partially covers the panel in the front channel, wherein a profile of the key is complimentary to a profile of the locking slot, and wherein inserting the key into the locking slot retains the front cover in place relative to the frame component.

EC 52. The method of any of the preceding or subsequent example combinations, further comprising inserting a spacer between the panel and the front cover after inserting the key into the locking slot, wherein inserting the spacer applies cantilevered pressure on the front cover.

EC 53. The method of any of the preceding or subsequent example combinations, wherein the front cover comprises a spacer monolithically formed with the front cover, and wherein inserting the key into the locking slot comprises simultaneously engaging the spacer with the panel.

EC 54. The method of any of the preceding or subsequent example combinations, wherein positioning the panel in the front channel comprises positioning the panel on a gasket on the channel surface.

EC 55. A demountable wall system comprising: a frame component comprising a base, the base comprising a front edge, a back edge opposite from the front edge, and a divider between the front edge and the back edge, wherein the frame component defines a front channel between the divider and the front edge, wherein the front channel comprises a channel surface, and wherein the frame component defines a locking slot in the front edge; and a front cover comprising a key, wherein a profile of the key is complimentary to a profile of the locking slot, and wherein the key is removably positionable within the locking slot such that the front cover covers the front channel at the front edge and the front cover is retained in place relative to the frame component.

EC 56. The demountable wall system of any of the preceding or subsequent example combinations, further comprising a spacer positioned on the front cover between the key and a top end of the front cover and within the front channel.

EC 57. The demountable wall system of any of the preceding or subsequent example combinations, wherein the locking slot extends continuously along a length of the frame component.

EC 58. The demountable wall system of any of the preceding or subsequent example combinations, wherein the key extends continuously along a length of the front cover.

EC 59. The demountable wall system of any of the preceding or subsequent example combinations, wherein the locking slot is a first locking slot, and wherein the frame component comprises a plurality of locking slots spaced apart along a length of the frame component.

EC 60. The demountable wall system of any of the preceding or subsequent example combinations, wherein the key is a first key, and wherein the front cover comprises a plurality of keys spaced apart along a length of the front cover.

EC 61. A demountable wall system comprising: a door; and a track, wherein the door is coupled to the track, wherein the track comprises a turn mechanism that is selectively engageable with the door, and wherein the turn mechanism is configured to move the door in a direction that is approximately 90 degrees relative to a longitudinal axis of the track.

EC 62. The demountable wall system of any of the preceding or subsequent example combinations, wherein the turn mechanism comprises a cylinder with a cutout region shaped to engage with a roller attached to the door.

EC 63. The demountable wall system of any of the preceding or subsequent example combinations, wherein the door is movable along the track between a retracted position and a closed position, and wherein the turn mechanism is engaged with the door when the door is in the closed position and disengaged from the door when the door is in the retracted position.

EC 64. The demountable wall system of any of the preceding or subsequent example combinations, wherein the door comprises a track roller and an engaging roller, wherein the track roller is configured to move along a surface of the track, and wherein the engaging roller is configured to engage the turn mechanism.

EC 65. The demountable wall system of any of the preceding or subsequent example combinations, wherein the engaging roller is positioned such that a planar surface of the engaging roller is oriented substantially perpendicular to a majority surface plane of the door.

EC 66. The demountable wall system of any of the preceding or subsequent example combinations, wherein the turn mechanism comprises a cylinder defining an axis of rotation and comprising a cutout region with a leading edge, wherein the turn mechanism is configured to engage with a roller attached to the door and move the roller from a closed position to an engaged position, and wherein the engaged position is approximately 180 degrees from the closed position.

EC 67. A demountable wall system comprising: a panel comprising a panel surface; a door; and a track defining a movement axis, wherein the door is coupled to the track and movable along the movement axis, and wherein the track comprises a turn mechanism that is configured to move the door in a direction that is substantially perpendicular to the panel surface.

EC 68. The demountable wall system of any of the preceding or subsequent example combinations, wherein the door is movable along the movement axis between a retracted position and a closed position, wherein, in the retracted position, the door at least partially covers the panel, and wherein, in the closed position, the door at least partially covers an opening in the panel.

EC 69. The demountable wall system of any of the preceding or subsequent example combinations, wherein the turn mechanism is configured to move the door from the closed position to an engaged position, and wherein, in both the closed position and the engaged position, the door at least partially covers an opening in the panel.

EC 70. The demountable wall system of any of the preceding or subsequent example combinations, wherein the door comprises a door surface, wherein, in the closed position, the door surface is substantially parallel to, but offset from, the panel surface, and wherein, in the engaged position, the door surface is coplanar with the panel surface.

EC 71. The demountable wall system of any of the preceding or subsequent example combinations, wherein the turn mechanism comprises a cylinder with a cutout region shaped to engage with a roller attached to the door.

EC 72. The demountable wall system of any of the preceding or subsequent example combinations, wherein the cylinder defines an axis of rotation, wherein the turn mechanism is configured to engage with the roller attached to the door and move the roller from a closed position to an engaged position, and wherein the engaged position is approximately 180 degrees from the closed position.

EC 73. The demountable wall system of any of the preceding or subsequent example combinations, wherein the panel comprises a mating edge define an opening in the panel, and wherein the demountable wall system further comprises a gasket on the mating edge.

EC 74. The demountable wall system of any of the preceding or subsequent example combinations, wherein the turn mechanism is configured to move the door from a closed position to an engaged position, wherein, in both the closed position and the engaged position, the door at least partially covers the opening, and wherein, in the engaged position, a peripheral edge of the door contacts the gasket.

EC 75. A demountable wall system comprising: a door; and a track defining a movement axis, wherein the door is coupled to the track and movable along the track in the movement axis between a retracted position and a closed position, and wherein the track comprises a turn mechanism that is configured to move the door in a direction that is substantially perpendicular to the movement axis when the door is in the closed position.

EC 76. The demountable wall system of any of the preceding or subsequent example combinations, wherein the turn mechanism comprises a cylinder with a cutout region shaped to engage with a roller attached to the door.

EC 77. The demountable wall system of any of the preceding or subsequent example combinations, wherein the door defines a door surface plane, and wherein an axis of the roller is substantially parallel to the door surface plane.

EC 78. The demountable wall system of any of the preceding or subsequent example combinations, wherein the cylinder comprises a cylinder axis, and wherein the cylinder is rotatable about the cylinder axis to move the door in the direction that is substantially perpendicular to the movement axis.

EC 79. The demountable wall system of any of the preceding or subsequent example combinations, wherein the door comprises a track roller and an engaging roller, wherein the track roller is configured to move along a surface of the track, and wherein the engaging roller is configured to engage the turn mechanism.

EC 80. The demountable wall system of any of the preceding or subsequent example combinations, wherein the turn mechanism is engaged with the door when the door is in the closed position and disengaged from the door when the door is in the retracted position.

EC 81. A method of joining two frame components comprising: inserting a first fastener into an internal location within a first frame component; coupling a second fastener to the first fastener; engaging the second fastener with a receptacle located in a second frame component; and adjusting the first fastener to pull adjoining ends of the two frame components together into a snug fit, wherein the first frame component and the second frame component are each configured to receive a portion of a panel.

EC 82. The method of any of the preceding or subsequent example combinations, further comprising forming an access portal in the first frame component, wherein the access portal provides access to the internal location within the first frame component.

EC 83. The method of any of the preceding or subsequent example combinations, wherein inserting the first fastener comprises inserting the first fastener through the access portal and into the internal location within the first frame component.

EC 84. The method of any of the preceding or subsequent example combinations, further comprising attaching the first fastener to the internal location within the first frame component after inserting the first fastener into the internal location.

EC 85. The method of any of the preceding or subsequent example combinations, further comprising coupling a third fastener to the second fastener.

EC 86. The method of any of the preceding or subsequent example combinations, wherein the third fastener engages the second fastener with the second frame component.

EC 87. The method of any of the preceding or subsequent example combinations, wherein coupling the third fastener to the second fastener comprises coupling the third fastener at a location on the second fastener opposite from the first fastener.

EC 88. The method of any of the preceding or subsequent example combinations, further comprising positioning a panel within the first frame component and the second frame component.

EC 89. The method of any of the preceding or subsequent example combinations, wherein adjusting the first fastener comprises engaging an adjustment tool with an interfacing surface of the first fastener and adjusting the adjustment tool to adjust the first fastener.

EC 90. The method of any of the preceding or subsequent example combinations, wherein engaging the second fastener comprises interlocking at least one extension of the second fastener with the receptacle within the second frame component.

EC 91. A system for joining two frame components, the system comprising: a first fastener engageable with a first frame component and adjustable within the first frame component; a second fastener engageable with the first fastener and a second frame component, wherein the second fastener is engaged with the first fastener such that adjustment of the first fastener induces linear displacement of the second fastener.

EC 92. The system of any of the preceding or subsequent example combinations, further comprising the first frame component, wherein the first frame component is configured to receive a portion of a panel.

EC 93. The system of any of the preceding or subsequent example combinations, further comprising the second frame component, wherein the second frame component is configured to receive another portion of the panel.

EC 94. The system of any of the preceding or subsequent example combinations, further comprising the first frame component and the second frame component, wherein the second fastener is engageable with the second frame component such that adjustment of the first fastener induces displacement of the second frame component.

EC 95. The system of any of the preceding or subsequent example combinations, wherein the second fastener is engaged with the second frame component such that adjustment of the first fastener induces displacement of the second frame component in a direction substantially perpendicular to an axis of the second fastener.

EC 96. A demountable wall system comprising: a first frame component, the first frame component comprising an end, a central receptacle and an open channel, wherein the first frame component is configured to receive a portion of a panel within the open channel; a second frame component, the second frame component comprising an end, a central receptacle and an open channel, wherein the second frame component is configured to receive a portion of a panel within the open channel of the second frame component; a first fastener within the central receptacle of the first frame component; and a second fastener coupled to the first fastener and engage with the central receptacle of the second frame component, wherein the second fastener is coupled to the first fastener such that adjustment of the first fastener induces linear displacement of the second fastener.

EC 97. The system of any of the preceding or subsequent example combinations, wherein the second fastener is engaged with the second frame component such that linear displacement of the second fastener pulls the ends of the first frame component and the second frame component together relative to each other or pushes the ends of the first frame component and the second frame component apart relative to each other.

EC 98. The system of any of the preceding or subsequent example combinations, wherein the first frame component further comprises an access portal providing access to the central receptacle.

EC 99. The system of any of the preceding or subsequent example combinations, further comprising an adjustment tool, wherein the adjustment tool is selectively insertable within the access portal such that the adjustment tool engages an interfacing surface of the first fastener.

EC 100. The system of any of the preceding or subsequent example combinations, further comprising a third fastener coupled with the second fastener, wherein the third fastener engages the second fastener with the second frame component.

EC 101. A demountable wall system comprising a frame component defining a front channel and locking slot; a front cover comprising a key, wherein the key is removably positionable within the locking slot such that the front cover covers a front portion of the front channel.

EC 102. A method of installing panel on a frame of a demountable wall system comprising positioning the panel in a front channel defined by a frame component of the frame; inserting a key of a front cover into a locking slot defined by the frame component such that the front cover partially covers the panel in the front channel; and inserting a wedge between the panel and the front cover.

EC 103. A demountable wall system comprising: a frame component defining a front channel; and a front cover removably attached to the frame component such that the front cover covers a front portion of the front channel.

EC 104. A method of installing a panel on a frame of a demountable wall system comprising: positioning the panel in a front channel defined by a frame component of the frame; removably attaching a front cover to the frame component such that the front cover partially covers the panel in the front channel; and inserting a wedge between the panel and the front cover.

EC 105. A demountable wall system comprising: a frame component defining a front channel; and a leveling base within the front channel, wherein the leveling base is vertically positionable within the front channel through at least one adjustment screw.

EC 106. A method of installing a panel on a frame of a demountable wall system comprising: positioning the panel in a front channel defined by a frame component of the frame and on a leveling base within the front channel; and vertically positioning at least a portion of the panel by adjusting at least one adjustment screw to vertically adjust a portion of the leveling base.

EC 107. A method of installing a panel on a frame of a demountable wall system comprising: vertically positioning a leveling base within a front channel defined by a frame component of the frame by adjusting at least one adjustment screw to vertically adjust a portion of the leveling base; and positioning the panel on the leveling base within the front channel.

EC 108. A demountable wall system comprising: a frame component defining a front channel and a back channel, wherein the front channel is configured to receive a panel, and wherein the back channel is configured to removably connect to a supplementary component.

EC 109. The demountable wall system of any of the preceding or subsequent example combinations, wherein the supplementary component is a back cover.

EC 111. The demountable wall system of any of the preceding or subsequent example combinations wherein the supplementary component is a supplemental frame component.

EC 111. A method of joining two frame components comprising: inserting a first fastener into an internal location within a first frame component; coupling a second fastener to the first fastener; engaging the second fastener with a receptacle located in a second frame component; adjusting the first fastener to pull adjoining ends of the two frame components together into a snug fit.

EC 112. The method of joining two frame components of any of the preceding or subsequent example combinations further comprising forming an access portal in the first frame component.

EC 113. The method of joining two frame components of any of the preceding or subsequent example combinations further comprising coupling a third fastener to the second fastener.

EC 114. The method of joining two frame components of any of the preceding or subsequent example combinations wherein the third fastener engages the second fastener with the second frame component.

EC 115. A system for joining two frame components, the system comprising: a first fastener engageable with a first frame component; a second fastener engageable with the first fastener and a second frame component; wherein adjustment of the first fastener induces linear displacement of the second fastener.

EC 116. A demountable wall system comprising: a door coupled to a track mechanism; the track mechanism comprising a mechanism configured to move the door in a direction that is approximately 90 degrees relative to a longitudinal axis of the track mechanism.

EC 117. The demountable wall system of any of the preceding or subsequent example combinations, wherein the mechanism comprises an offset turn mechanism comprising a cylinder with a cutout region shaped to engage with a roller attached to the door.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A demountable wall system comprising:

a frame component defining a front channel; and a leveling base within the front channel and comprising a support surface, wherein the leveling base is vertically positionable within the front channel through at least one adjustment mechanism such that a vertical position of the support surface within the front channel is controlled, and wherein the frame component is configured to support a panel within the front channel and on the leveling base.

2. The demountable wall system of claim 1, wherein the at least one adjustment mechanism comprises a set screw retained on a leveling post of the frame component, wherein the set screw is threadably engaged with the leveling base, and wherein the leveling post is within the front channel.

3. The demountable wall system of claim 1, wherein the leveling base is vertically positionable between a lowest position and a highest position, and wherein, in both the lowest position and the highest position, the support surface is within the front channel.

4. The demountable wall system of claim 1, wherein the at least one adjustment mechanism is a first adjustment mechanism at a first position along a length of the leveling base, and wherein the demountable wall system further comprises a second adjustment mechanism at a second position along the length of the leveling base.

5. The demountable wall system of claim 4, wherein the first adjustment mechanism and the second adjustment mechanism are independently adjustable.

6. The demountable wall system of claim 1, wherein the support surface comprises a spacer, and wherein the frame component is configured to support the panel within the front channel and on the spacer.

7. The demountable wall system of claim 1, wherein a length of the leveling base is approximately equal to a length of the frame component.

* * * * *